US011153685B2

(12) United States Patent
Toguri

(10) Patent No.: US 11,153,685 B2
(45) Date of Patent: Oct. 19, 2021

(54) AUDIO OUTPUT CONTROLLER, AUDIO OUTPUT CONTROL METHOD, AND PROGRAM

(71) Applicant: Sony Corporation, Tokyo (JP)

(72) Inventor: Yasuhiro Toguri, Kanagawa (JP)

(73) Assignee: Sony Corporation, Tokyo (JP)

( * ) Notice: Subject to any disclaimer, the term of this patent is extended or adjusted under 35 U.S.C. 154(b) by 50 days.

(21) Appl. No.: 16/611,981

(22) PCT Filed: May 2, 2018

(86) PCT No.: PCT/JP2018/017493
§ 371 (c)(1),
(2) Date: Nov. 8, 2019

(87) PCT Pub. No.: WO2018/211988
PCT Pub. Date: Nov. 22, 2018

(65) Prior Publication Data

US 2021/0144476 A1 May 13, 2021

(30) Foreign Application Priority Data

May 17, 2017 (JP) ..... JP2017-098084

(51) Int. Cl.
*H04R 3/12* (2006.01)
*G10L 25/51* (2013.01)
(Continued)

(52) U.S. Cl.
CPC ..... *H04R 3/12* (2013.01); *G10L 25/51* (2013.01); *H04R 1/08* (2013.01); *H04R 1/403* (2013.01);
(Continued)

(58) Field of Classification Search
None
See application file for complete search history.

(56) References Cited

U.S. PATENT DOCUMENTS 4,361,727 A * 11/1982 Franssen ..... G10K 15/10 381/63
5,025,472 A * 6/1991 Shimizu ..... G10H 1/0091 381/63
(Continued)

FOREIGN PATENT DOCUMENTS

EP 3 261 362 A1 12/2017
WO WO 2008/111023 A2 9/2008
(Continued)

OTHER PUBLICATIONS

Extended European Search Report dated Mar. 31, 2020 in connection with European Application No. 18802088.7.
(Continued)

*Primary Examiner* — Paul W Huber
(74) *Attorney, Agent, or Firm* — Wolf, Greenfield & Sacks, P.C.

(57) ABSTRACT

The present technology relates to an audio output controller, an audio output control method, and a program that can improve sound quality.
An audio output controller includes multiple speaker units installed so as to face different directions, outputs measurement sound from at least one speaker unit of the multiple speaker units, and controls a gain of the speaker unit on the basis of a reverberation characteristic when the measurement sound is measured by a microphone in a predetermined position. Measurement sound output from a speaker unit installed in another audio output controller is measured by the microphone. Alternatively, measurement sound output from an installed speaker unit is measured by the microphone. The present technology can be applied to a wireless speakers, for example.

13 Claims, 12 Drawing Sheets

(51) Int. Cl.
*H04R 1/08* (2006.01)
*H04R 1/40* (2006.01)
*H04R 29/00* (2006.01)

(52) U.S. Cl.
CPC ..... *H04R 29/002* (2013.01); *H04R 2201/401* (2013.01); *H04R 2430/01* (2013.01)

(56) References Cited

U.S. PATENT DOCUMENTS

| | | | | |
|---|---|---|---|---|
| 2010/0104114 | A1 | 4/2010 | Chapman | |
| 2010/0296662 | A1 | 11/2010 | Tanaka | |
| 2015/0237446 | A1* | 8/2015 | Katayama | H04S 3/008 381/163 |
| 2018/0034434 | A1 | 2/2018 | Fakue et al. | |
| 2020/0382892 | A1* | 12/2020 | Mehta | H04S 7/30 |

FOREIGN PATENT DOCUMENTS

| | | | |
|---|---|---|---|
| WO | WO 2009/093416 | A1 | 7/2009 |
| WO | WO 2014/035903 | A1 | 3/2014 |
| WO | WO 2016/028264 | A1 | 2/2016 |
| WO | WO 2016/133007 | A1 | 8/2016 |

OTHER PUBLICATIONS

International Search Report and Written Opinion and English translations thereof dated Aug. 7, 2018 in connection with International Application No. PCT/JP2018/017493.

International Preliminary Report on Patentability and English translation thereof dated Nov. 28, 2019 in connection with International Application No. PCT/JP2018/017493.

* cited by examiner

FIG. 17
| | 2S-1 | 2S-2 | 2S-3 | 2S-4 | 2M-1 | 2M-2 | 2M-3 | 2M-4 |
|---|---|---|---|---|---|---|---|---|
| RT60 | 2.2 | 2.5 | 1.5 | 3.0 | 2.7 | 3.5 | 4.0 | 2.0 |
FIG. 18
| | 2S-1 | 2S-2 | 2S-3 | 2S-4 | 2M-1 | 2M-2 | 2M-3 | 2M-4 |
|---|---|---|---|---|---|---|---|---|
| SETTING EXAMPLE 1 | 1.0 | 1.0 | 1.0 | 0 | 1.0 | 1.0 | 0 | 1.0 |
| SETTING EXAMPLE 2 | 1.0 | 1.0 | 1.0 | 1.0 | 1.0 | 0 | 0 | 1.0 |
| SETTING EXAMPLE 3 | 1.0 | 1.0 | 1.0 | 0.75 | 0.9 | 0.5 | 0.25 | 1.0 |
| SETTING EXAMPLE 5 | 1.0 | 1.0 | 1.0 | 0.75 | 1.0 | 1.0 | 0.25 | 1.0 |
FIG. 19
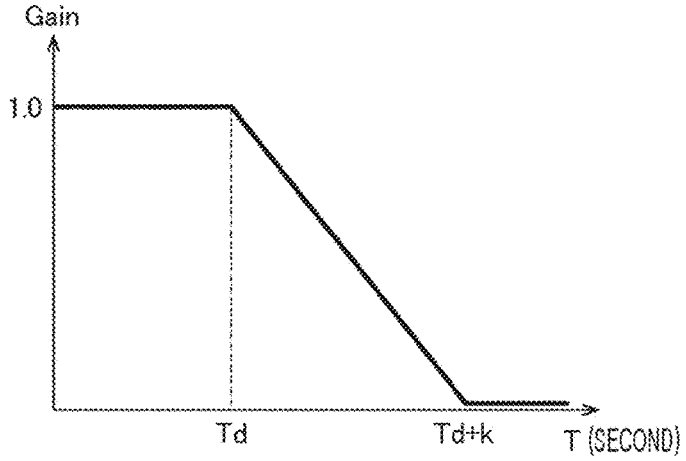
FIG. 20
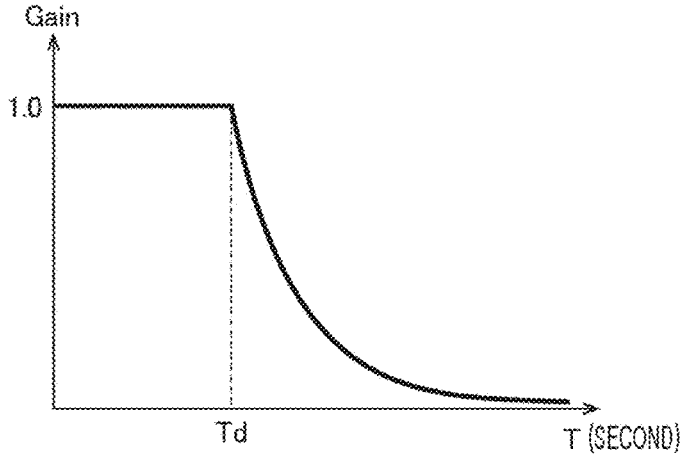

AUDIO OUTPUT CONTROLLER, AUDIO OUTPUT CONTROL METHOD, AND PROGRAM

CROSS-REFERENCE TO RELATED APPLICATIONS

This application claims the benefit under 35 U.S.C. § 371 as a U.S. National Stage Entry of International Application No. PCT/JP2018/017493, filed in the Japanese Patent Office as a Receiving Office on May 2, 2018, which claims priority to Japanese Patent Application Number JP2017-098084, filed in the Japanese Patent Office on May 17, 2017, each of which is hereby incorporated by reference in its entirety.

TECHNICAL FIELD

The present technology relates to an audio output controller, an audio output control method, and a program, and, for example, to an audio output controller, an audio output control method, and a program suitable for use in controlling audio output of a wireless speaker.

BACKGROUND ART

In recent years, demands for wireless speakers using Bluetooth (registered trademark), Wi-Fi (registered trademark), or the like are increasing since they do not require wiring and can be placed in any desired position in a room. Additionally, in order to provide for reproduction in various arrangements and orientations, some speakers have symmetrical shapes such as a tubular shape, for example. With such a symmetrical speaker, it is possible to spread sound in all directions of the room regardless of the orientation and arrangement.

Additionally, multiple wireless speakers are used for reproduction of respective audio channels in many cases. For example, a wireless speaker is provided for each of a left channel, a right channel, a surround-left channel, a surround-right channel, and the like.

It has also been proposed to transmit an audio signal to each speaker by radio transmission from a mobile data terminal such as a smartphone or a tablet, and to perform reproduction by synchronizing the timing among the speakers. At this time, the arrival time of sound, the frequency characteristic of sound, and the like at the user's listening point change depending on the position and orientation of each speaker. Hence, it has also been proposed to correct the reproduction timing and frequency characteristic with signal processing of an equalizer, a delay unit, or the like on the basis of a measurement result of a microphone at the listening point (see Patent Document 1, for example).

CITATION LIST

Patent Document

Patent Document 1: Japanese Patent Application Laid-Open No. 2007-13707

SUMMARY OF THE INVENTION

Problems to be Solved by the Invention

Not only in a wireless speaker, but in speakers in general, unintended reflection or reverberation may occur on the wall or ceiling of a room, furniture, or the like, and sound quality at the user listening point is degraded in some cases. In particular, since a wireless speaker does not require wiring and can be placed in any desired position in a room as described above, there is a possibility that the speaker could be placed in an inappropriate position. Also, in the case of a wireless speaker that spreads sound in all directions, the influence of reverberation, echo, or the like may also be significant.

In order to obtain the optimum sound quality, the user needs to adjust the arrangement, orientation, and the like of multiple speakers in a trial and error manner in advance according to the room environment. Although a method of suppressing reverberation and reflection at a listening point by signal processing has also been proposed, it is difficult to perform dereverberation in a wide area by signal processing. For example, even if control can be appropriately performed at a certain listening point, there is a possibility that the control cannot be appropriately performed when the room environment or the listening position changes.

The present technology has been made in view of such a situation, and aims to suppress excess reverberation.

Solutions to Problems

An audio output controller according to one aspect of the present technology includes multiple speaker units installed so as to face different directions. Measurement sound is output from at least one speaker unit of the multiple speaker units, and a gain of the speaker unit is controlled on the basis of a reverberation characteristic when the measurement sound is measured by a microphone in a predetermined position.

An audio output method according to one aspect of the present technology is an audio output control method of an audio output controller including multiple speaker units installed so as to face different directions, the method including the steps of outputting measurement sound from at least one speaker unit of the multiple speaker units, and controlling a gain of the speaker unit on the basis of a reverberation characteristic when the measurement sound is measured by a microphone in a predetermined position.

A program according to one aspect of the present technology causes a computer that controls an audio output controller including multiple speaker units installed so as to face different directions to perform processing including the steps of outputting measurement sound from at least one speaker unit of the multiple speaker units, and controlling a gain of the speaker unit on the basis of a reverberation characteristic when the measurement sound is measured by a microphone in a predetermined position.

In an audio output controller, an audio output method, and a program according to one aspect of the present technology, multiple speaker units installed so as to face different directions are included, measurement sound is output from at least one speaker unit of the multiple speaker units, the measurement sound is measured by a microphone in a predetermined position, a reverberation characteristic is calculated from the measurement result, and a gain of the speaker unit is controlled on the basis of the reverberation characteristic.

Note that the audio output controller may be an independent device, or may be an internal block included in one device.

Additionally, the program can be provided by being transmitted through a transmission medium or being recorded on a recording medium.

Effects of the Invention

According to an aspect of the present technology, excess reverberation can be suppressed.

Note that the effect described herein is not necessarily limited, and the effect may be any of those described in the present disclosure.

BRIEF DESCRIPTION OF DRAWINGS

FIG. 17 is a diagram showing an example of measurement of reverberation.

FIG. 18 is a diagram showing an example of set gains.

FIG. 19 is a diagram for describing the method of setting a gain.

FIG. 20 is a diagram for describing the method of setting a gain.

MODE FOR CARRYING OUT THE INVENTION

Hereinafter, a mode for carrying out the present technology (hereinafter referred to as embodiment) will be described.

<Configuration of Audio Output Controller>

The present technology can be applied to an audio output controller. The audio output controller to which the present technology is applied can be a speaker device, for example. Additionally, the present technology can be applied to a system including multiple audio output controllers (speaker devices).

Additionally, the audio output controller (speaker device) can include multiple speaker units to be able to provide sound that spreads in all directions. Additionally, the speaker device can be a wireless speaker using Bluetooth (registered trademark), Wi-Fi (registered trademark) or the like. Here, the description will be continued by taking, as an example, a case where the audio output controller is such a wireless speaker.

Figure 1:
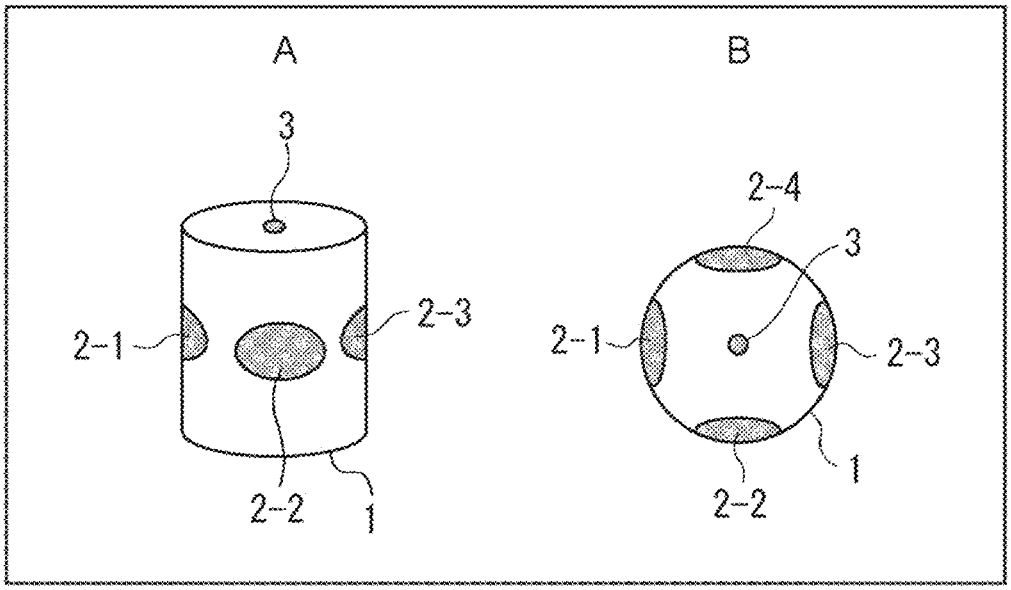
FIG. 1 is a diagram showing a configuration of an embodiment of an audio output controller to which the present technology is applied.

FIG. 1 is a diagram showing a configuration of an embodiment of a wireless speaker (audio output controller) that forms a system to which the present technology is applied.

A of FIG. 1 is a side view of a wireless speaker 1, and B of FIG. 1 is a top view of the wireless speaker 1. The wireless speaker 1 shown in FIG. 1 is formed in a cylindrical shape, and four speaker units 2-1 to 2-4 are provided on a side surface thereof. Additionally, a microphone 3 is provided on a top surface of the wireless speaker 1.

Note that while the description herein is continued by taking, as an example, the case where the wireless speaker 1 has a cylindrical shape, the wireless speaker 1 may be formed in a symmetrical shape, for example, a polygonal prism such as a quadrangular prism or a hexagonal prism, an elliptic prism, a triangular pyramid (tetrahedron), a quadrangular pyramid, or the like. In the following, the description will be continued by taking, as an example, a case where a housing of the wireless speaker has a cylindrical shape.

In order to spread sound in all directions regardless of the orientation, in the wireless speaker 1 shown in FIG. 1, multiple speaker units 2 are attached to a side surface of the housing of the wireless speaker 1 so as to face different directions.

Additionally, the speaker units 2 shown in FIG. 1 show an example where they are arranged on the same horizontal plane (the same height). However, the present invention is not limited to the case where the speaker units 2 are arranged at the same height, and they may be arranged at different heights.

Additionally, while the wireless speaker 1 shown in FIG. 1 is an example in which four speaker units 2 are attached, the number is not limited to four, and it may be two, five, or other numbers, as long as multiple speaker units 2 are provided.

Additionally, the speaker units 2 may be the same unit, or may be units of different types or different sizes. For example, as shown in FIG. 2, a woofer unit 11 with a large aperture and a tweeter unit 12 with a small aperture may be combined and provided.

Figure 2:
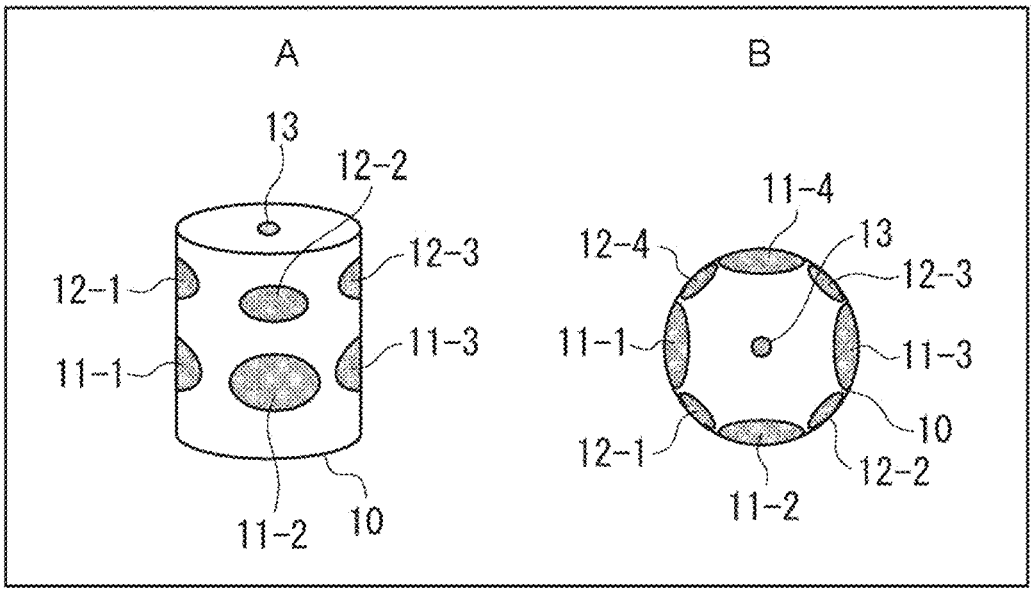
FIG. 2 is a diagram showing another configuration of the embodiment of the audio output controller to which the present technology is applied.

A of FIG. 2 is a side view of a wireless speaker 10, and B of FIG. 2 is a top view of the wireless speaker 10. Four woofer units 11-1 to 11-4 are provided below the center of a side surface of the wireless speaker 10 having a cylindrical housing, and four tweeter units 12-1 to 12-4 are provided above the center.

Additionally, the woofer units 11-1 to 11-4 shown in FIG. 2 are not arranged on the same horizontal plane (the same height), but are arranged by varying the heights slightly. Similarly, the tweeter units 12-1 to 12-4 shown in FIG. 2 are not arranged on the same horizontal plane (the same height), but are arranged by varying the heights slightly.

In this way, by varying the heights of different types of units and attaching them, it is possible to spread sound in the entire room even in the height direction.

The wireless speaker 1 shown in FIG. 1 is provided with the microphone 3, and the wireless speaker 10 shown in FIG. 2 is provided with a microphone 13. The microphone 3

(microphone 13) is provided to collect measurement sound and calculate the reverberation characteristic.

As will be described later, the microphone 3 (13) is used to perform processing to deliver audio with suppressed reverberation and reflection to the user, for example.

While the description will be continued assuming that the microphone 3 (13) is provided on the top surface of the wireless speaker 1 (10), the attachment position of the microphone 3 (13) is not limited to the top surface of the wireless speaker 1 (10), and may be another surface (side surface).

Figure 3:
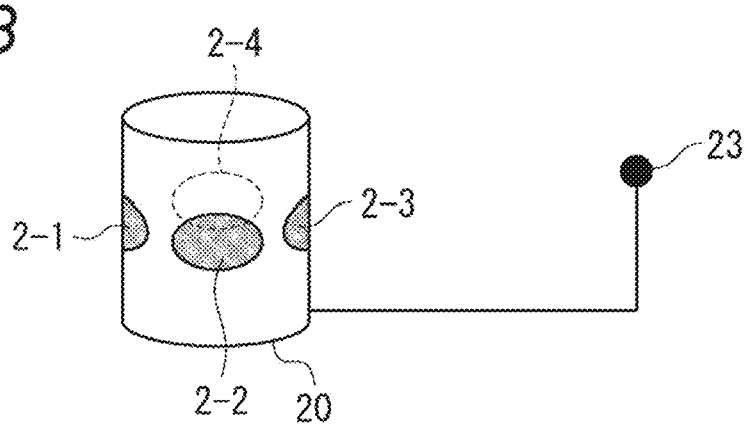
FIG. 3 is a diagram showing another configuration of the embodiment of the audio output controller to which the present technology is applied.

Additionally, as shown in FIG. 3, the microphone may be attached at a position different from the housing of the wireless speaker 1. Referring to FIG. 3, a wireless speaker 20 and a microphone 23 are connected in a wired or wireless manner. The wireless speaker 20 is configured differently from the wireless speaker 1 (FIG. 1) in that the housing is not provided with a microphone, but other configurations are similar to those of the wireless speaker 1 (FIG. 1).

Figure 4:
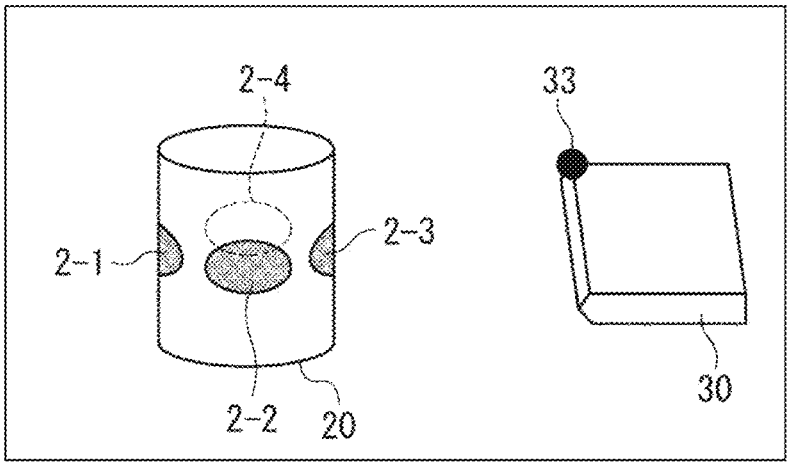
FIG. 4 is a diagram showing another configuration of the embodiment of the audio output controller to which the present technology is applied.

Additionally, as shown in FIG. 4, a microphone provided in another device (mobile terminal device) may be used as a microphone for reverberation measurement. Referring to FIG. 4, a microphone 33 provided in a mobile terminal device 30 different from the wireless speaker 20 is used as a microphone for reverberation measurement.

In the case of such a configuration, the microphone 33 (mobile terminal device 30) and the wireless speaker 20 are connected in a wired or wireless manner, and are capable of exchanging data.

For example, the mobile terminal device 30 can be an existing product such as a mobile phone, a smartphone, or a tablet. Additionally, the mobile terminal device 30 may be any device as long as it includes a microphone for measuring reverberation.

As has been described with reference to FIGS. 1 to 4, the wireless speaker includes the microphone for reverberation measurement in a housing portion or a portion different from the housing. Additionally, the wireless speaker includes multiple speaker units, and the multiple speaker units are installed so as to face different directions in order to spread sound.

While the wireless speaker 1 shown in FIG. 1 is described as an example in the following description, the present technology described below is applicable also to the wireless speakers shown in FIGS. 2 to 4.

<System Configuration at Time of Reverberation Measurement>

Since the wireless speaker 1 described above does not require wiring and can be placed in any desired position in a room, there is a possibility that the speaker could be placed in an inappropriate position where sound quality is degraded at the user's listening point.

Figure 5:
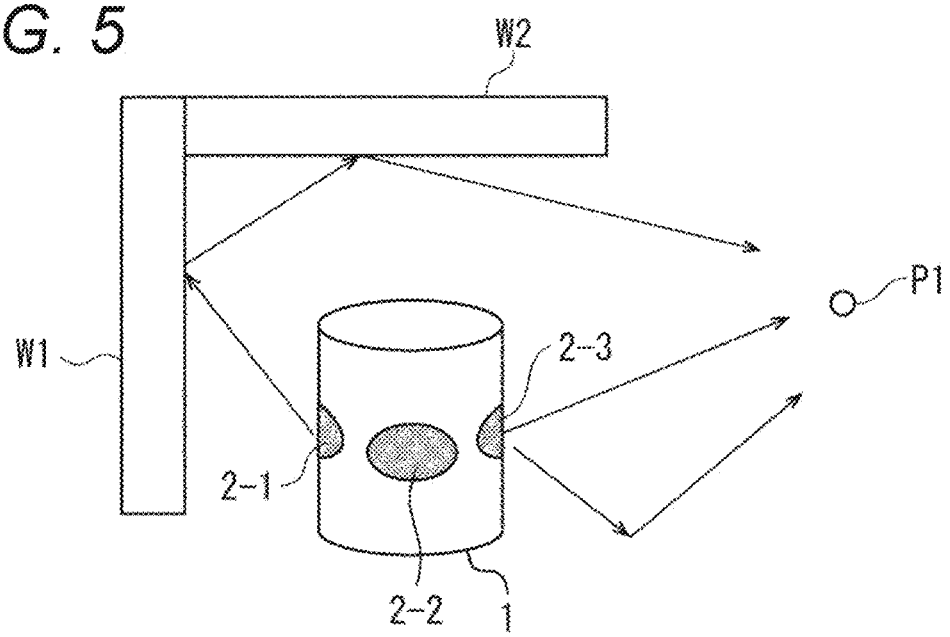
FIG. 5 is a diagram for describing reverberation and reflected sound.

Additionally, since the multiple speaker units 2 are attached to the side surface of the wireless speaker 1 so as to face different directions in order to spread sound in all directions regardless of the orientation as shown in FIG. 1, unintended reflection or reverberation may occur on the wall or ceiling of a room, furniture, or the like, as shown in FIG. 5.

Referring to FIG. 5, the wireless speaker 1 is arranged in the vicinity of a wall W1 and a ceiling W2. In this case, the sound from a speaker unit 2-3 includes sound that is delivered directly to a user's listening point P1, and sound that is delivered by being reflected on an unillustrated floor (e.g., top plate of furniture on which wireless speaker 1 is placed).

Additionally, the sound from the speaker unit 2-1 is delivered to the user's listening point P1 by being reflected by the wall W1 and reflected by the ceiling W2. The sound from other speaker units 2-2 and 2-4 also include sound that is delivered directly to the user's listening point P1 and sound delivered by being reflected.

Thus, reflection and reverberation occur on the wall or ceiling of a room, furniture, or the like, and may degrade sound quality at the user's listening point P1. Against this background, processing for reducing such reflection and reverberation and suppressing degradation of sound quality at the listening point P1 will be described.

Specifically, processing is performed to identify the speaker unit 2 that is the cause that degrades sound quality such as reflection and reverberation (reverberation in this case) from among the multiple (four in this case) speaker units 2-1 to 2-4 of the wireless speaker 1, and to reduce sound from the identified speaker unit 2 (reduce output gain), for example.

In other words, reverberation is measured, and the gain of each speaker unit 2 is set on the basis of the measured result. Here, as a method of measuring reverberation, the following three modes will be described as an example.

A first mode (referred to as autonomous measurement mode) is a mode in which the wireless speaker 1 outputs measurement sound for reverberation measurement from each speaker unit 2, the microphone 3 included in the wireless speaker 1 that outputs the measurement sound collects the output measurement sound to measure reverberation of each speaker unit 2, and the gain of each speaker unit 2 is set on the basis of the measurement result.

A second mode (referred to as master-slave measurement mode) is performed by two wireless speakers 1, and is a mode in which measurement sound for reverberation measurement is output from one wireless speaker 1, the measurement sound is collected by the microphone 3 of the other wireless speaker 1, and the gain is set according to the collected sound and transmitted to the wireless speaker 1 that outputs the measurement sound. The gain of each speaker unit 2 is set in this manner.

A third mode (referred to as slave measurement mode) is a mode in which measurement sound for reverberation measurement is collected by the microphone 33 of the mobile terminal device 30 as shown in FIG. 4, whereby the gain is set for each speaker unit 2 of the wireless speaker 1 that outputs the measurement sound.

The wireless speaker in the first mode or the second mode can be any of the wireless speaker 1 shown in FIG. 1, the wireless speaker 10 shown in FIG. 2, or the wireless speaker 20 shown in FIG. 3. Additionally, the wireless speaker in the third mode can be the wireless speaker 20 shown in FIG. 3 (FIG. 4). <Configuration and Operation of Wireless Speaker in First Mode>

Figure 6:
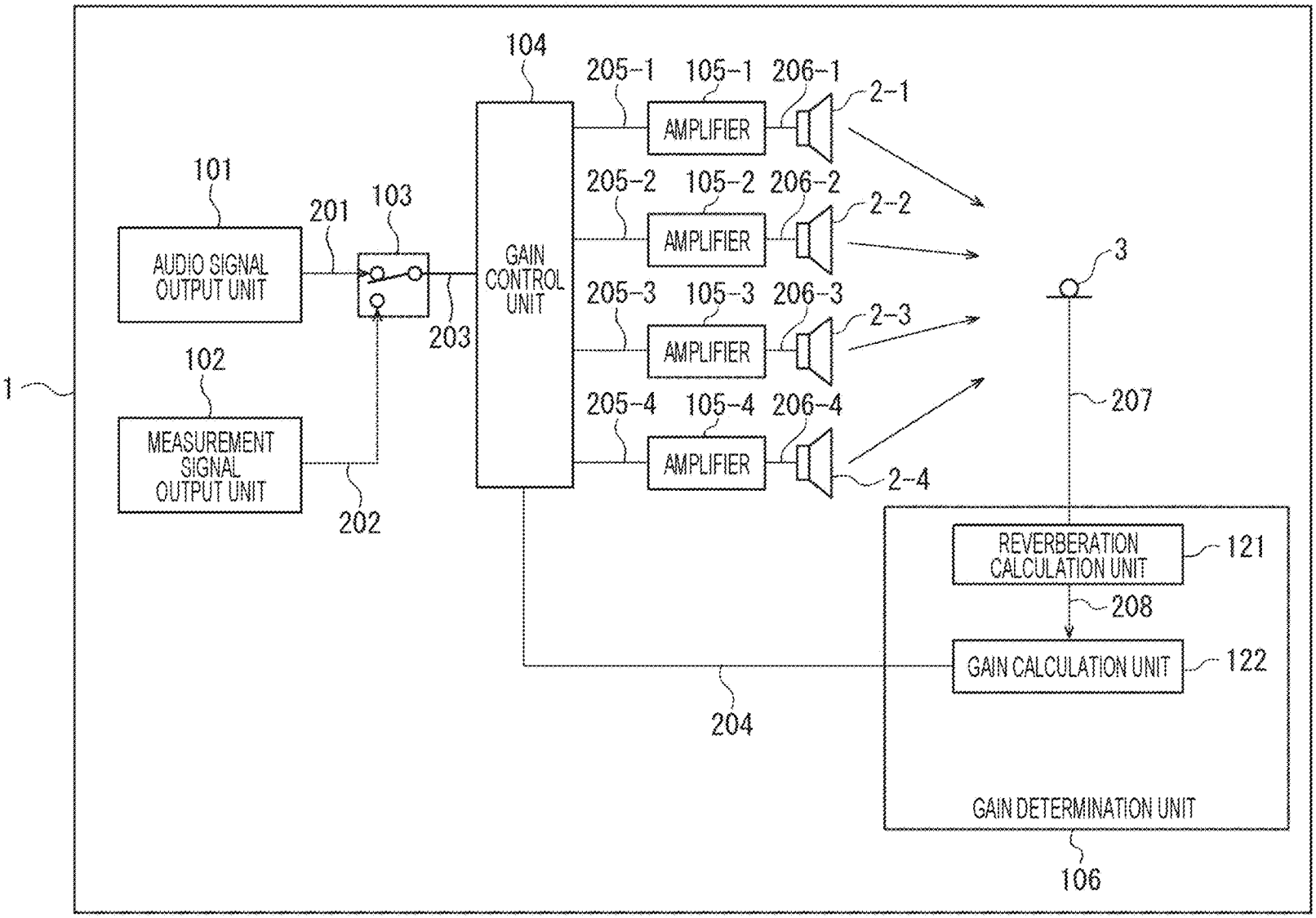
FIG. 6 is a diagram showing an internal configuration example of the audio output controller.

FIG. 6 is a diagram showing a configuration example of the wireless speaker 1 in the first mode (autonomous measurement mode).

The wireless speaker 1 includes an audio signal output unit 101, a measurement signal output unit 102, a switch 103, a gain control unit 104, amplifiers 105-1 to 105-4, and a gain determination unit 106. The wireless speaker 1 also includes the speaker units 2-1 to 2-4 and the microphone 3.

The audio signal output unit 101 receives an audio signal transmitted from a server in a wirelessly connected network or a reproduction device different from the wireless speaker 1, and outputs an audio reproduction signal 201 to the switch 103. Additionally, in a case where the wireless speaker 1 is paired with another wireless speaker 1, the audio signal output unit 101 also performs synchronization processing of reproduction timing with the paired wireless speaker 1.

At the time of measuring the impulse response of the speaker unit 2, the measurement signal output unit 102 outputs a measurement signal 202 to the switch 103. As a signal for measurement of impulse response, for example, a time stretched pulse (TSP) signal, an M-sequence signal can be used, or the like.

The switch 103 switches between the audio reproduction signal 201 and the measurement signal 202, and outputs a reproduction signal 203 to the gain control unit 104. The mode in which the switch 103 outputs the audio reproduction signal 201 is referred to as an audio reproduction mode. Meanwhile, the mode in which the switch 103 outputs the measurement signal 202 is the reverberation measurement mode described above, and is a first mode.

In the audio reproduction mode, the gain control unit 104 multiplies the reproduction signal 203 by the gain set in the speaker units 2-1 to 2-4 on the basis of gain control information 204 supplied from the gain determination unit 106, and generates unit output signals 205-1 to 205-4.

Additionally, in the reverberation measurement mode (first mode in this case), the gain control unit 104 sets the gain corresponding to the speaker unit 2 for measuring reverberation to 1, and the gain for the other speaker units 2 to 0 (mute).

For example, the gain control unit 104 sequentially sets the gains of the speaker units 2-1 to 2-4 to "1". Additionally, in the reverberation measurement mode, the measurement signal output unit 102 continuously outputs measurement signals for the number of speaker units 2 at predetermined intervals. By performing such processing in each unit, measurement signals are sequentially output from the speaker units 2-1 to 2-4.

The unit output signals 205-1 to 205-4 generated by the gain control unit 104 are supplied to the amplifiers 105-1 to 105-4, respectively.

The amplifiers 105-1 to 105-4 are amplifiers for the speaker units 2-1 to 2-4, respectively, and amplify the supplied unit output signals 205-1 to 205-4 to generate unit output signals 206-1 to 206-4, respectively. The generated unit output signals 206-1 to 206-4 are supplied to the corresponding speaker units 2-1 to 2-4, respectively.

The gain determination unit 106 includes a reverberation calculation unit 121 and a gain calculation unit 122.

The reverberation calculation unit 121 calculates a reverberation characteristic 208 from a measurement signal 207 collected by the microphone 3, and supplies the reverberation characteristic 208 to the gain calculation unit 122. Although details will be described later, as the reverberation characteristic 208, an impulse response signal, a decay curve of reverberation energy, a reverberation time called RT60, or the like can be used, for example.

The gain calculation unit 122 calculates the gain control information 204 of the speaker unit 2 on the basis of the supplied reverberation characteristic 208 so as to obtain a desired reverberation characteristic. The calculation method of the gain control information 204 will also be described later in detail. The gain control information 204 calculated by the gain calculation unit 122 is supplied to the gain control unit 104.

Next, an operation of the wireless speaker 1 shown in FIG. 6 will be described.

The wireless speaker 1 has an audio reproduction mode for reproducing an audio signal, and a reverberation measurement mode for measuring reverberation and setting a gain. Additionally, the reverberation measurement mode is the first mode described above, and is a mode (autonomous measurement mode) in which the wireless speaker 1 performs processing to output sound for measurement, collect the sound with the microphone 3, obtain the reverberation characteristic, and set the gain.

First, with reference to FIG. 7, an operation of the wireless speaker 1 in the audio reproduction mode will be described.

In step S11, the switch 103 is switched to the side where the audio signal output unit 101 and the gain control unit 104 are connected. By switching the switch 103, the audio reproduction signal 201 from the audio signal output unit 101 is supplied to the gain control unit 104 through the switch 103.

In step S12, an audio signal to which a predetermined gain is applied on the basis of gain control information is reproduced.

The gain set during the reverberation measurement mode is set in the gain control unit 104. The gain is set for each speaker unit 2.

The gain control unit 104 multiplies the audio reproduction signal 201 (reproduction signal 203 supplied through the switch 103) supplied from the audio signal output unit 101 by the gains set for each of the speaker units 2-1 to 2-4, and supplies the results to the corresponding amplifiers 105-1 to 105-4.

The gain control unit 104 multiplies the reproduction signal 203 by the gain 2-1 set in the speaker unit 2-1 to generate the unit output signal 205-1, and supplies the unit output signal 205-1 to the amplifier 105-1. The amplifier 105-1 amplifies the supplied unit output signal 205-1 with the set amplification factor, generates the amplified unit output signal 206-1, and supplies it to the speaker unit 2-1. The speaker unit 2-1 outputs the supplied unit output signal 206-1.

Similarly, the gain control unit 104 multiplies the reproduction signal 203 by the gain 2-2 set in the speaker unit 2-2 to generate the unit output signal 205-2, and supplies the unit output signal 205-2 to the amplifier 105-2. The amplifier 105-2 amplifies the supplied unit output signal 205-2 with the set amplification factor, generates the amplified unit output signal 206-2, and supplies it to the speaker unit 2-2. The speaker unit 2-2 outputs the supplied unit output signal 206-2.

Similarly, the gain control unit 104 multiplies the reproduction signal 203 by the gain 2-3 set in the speaker unit 2-3 to generate the unit output signal 205-3, and supplies the unit output signal 205-3 to the amplifier 105-3. The amplifier 105-3 amplifies the supplied unit output signal 205-3 with the set amplification factor, generates the amplified unit output signal 206-3, and supplies it to the speaker unit 2-3. The speaker unit 2-3 outputs the supplied unit output signal 206-3.

Furthermore, similarly, the gain control unit 104 multiplies the reproduction signal 203 by the gain 2-4 set in the speaker unit 2-4 to generate the unit output signal 205-4, and supplies the unit output signal 205-4 to the amplifier 105-4. The amplifier 105-4 amplifies the supplied unit output signal 205-4 with the set amplification factor, generates the amplified unit output signal 206-4, and supplies it to the speaker unit 2-4. The speaker unit 2-4 outputs the supplied unit output signal 206-4.

As described above, the gain set for each speaker unit 2 is multiplied by the gain control unit 104, so that the sound output from each speaker unit 2 is output as a sound according to the gain. Since gain is set to reduce reverberation, it is possible to provide a sound with improved sound quality at the user's listening point.

Next, the method of setting the gain, that is, the operation of the wireless speaker 1 in the reverberation measurement mode will be described with reference to the flowchart of FIG. 8. Here, as described above, an operation in the first mode (autonomous measurement mode) will be described.

In step S31, the switch 103 is switched to the side where the measurement signal output unit 102 and the gain control unit 104 are connected. By switching the switch 103, the measurement signal 202 from the measurement signal output unit 102 is supplied to the gain control unit 104 through the switch 103.

In step S32, the units other than the measurement target speaker unit 2 are muted, and the measurement sound is output only from the measurement target speaker unit 2. The gain control unit 104 sets the gain of the measurement target speaker unit 2 to 1, for example, and sets the gain of the speaker unit 2 that is not a measurement target to 0. Note that the gain for the measurement target speaker unit 2 may be a gain other than 1.

In step S32, if the measurement target speaker unit 2 is the speaker unit 2-1, for example, the gain for the speaker unit 2-1 is set to 1, and the gains of the speaker units 2-2 to 2-4 are set to 0. Hence, in this case, measurement sound is output only from the speaker unit 2-1.

That is, the gain control unit 104 multiplies the reproduction signal 203 (measurement signal 202) by the gain 2-1 (1 in this case) set in the speaker unit 2-1 to generate the unit output signal 205-1, and supplies the unit output signal 205-1 to the amplifier 105-1.

The amplifier 105-1 amplifies the supplied unit output signal 205-1 with the set amplification factor, generates the amplified unit output signal 206-1, and supplies it to the speaker unit 2-1. The speaker unit 2-1 outputs the supplied unit output signal 206-1 (measurement sound).

Additionally, the gain control unit 104 similarly multiplies the reproduction signal 203 (measurement signal 202) by the set gain (0 in this case) for the measurement sound supplied to each of the speaker units 2-2 to 2-4, too, to generate the unit output signals 205-2 to 205-4, respectively, and supplies the unit output signals 205-2 to 205-4 to the amplifiers 105-2 to 105-4, respectively.

In this case, since the gain is 0, the unit output signals 205-2 to 205-4 are muted. Hence, measurement sound is not output from the speaker units 2-2 to 2-4.

In step S33, the measurement sound is collected by the microphone 3. In step S34, the gain determination unit 106 calculates the gain.

For example, if the measurement target is the speaker unit 2-1, the measurement sound output from the speaker unit 2-1 is collected by the microphone 3. Then, the measurement signal 207 collected by the microphone 3 is supplied to the reverberation calculation unit 121 of the gain determination unit 106. The reverberation calculation unit 121 calculates the reverberation characteristic 208 from the measurement signal 207.

The gain calculation unit 122 calculates, from the reverberation characteristic 208, a gain that achieves a desired reverberation characteristic. Calculation of the reverberation characteristic 208 and calculation of the gain will be described after the description of the first to third modes.

By performing such processing, in this case, the gain for the speaker unit 2-1 is calculated such that the sound from the speaker unit 2-1 has a desired reverberation characteristic.

In step S35, the gain calculated by the gain determination unit 106 is supplied to the gain control unit 104, and is set as the gain for the measurement target speaker unit 2.

In step S36, it is determined whether or not measurement sound has been output from all the units. In the case of the wireless speaker 1 shown in FIG. 1, since four speaker units 2-1 to 2-4 are provided, in step S36, it is determined whether or not measurement sound has been output from all of the speaker units 2-1 to 2-4, in other words, it is determined whether or not the gain has been set for all of the speaker units 2-1 to 2-4.

In step S36, in a case where it is determined that the measurement sound has not been output from all the units, the speaker unit 2 which has not output the measurement sound yet is set as the measurement target, and the processing of step S32 and subsequent steps is repeated. On the other hand, in a case where it is determined in step S36 that the measurement sound has been output from all the units, the processing of the first mode is ended.

As described above, measurement sound is output for each of the speaker units 2, a reverberation characteristic is obtained from the collected measurement sound, and the reverberation characteristic is used to set a gain that achieves a desired reverberation characteristic.

Since the gain is set as a gain that achieves a desired reverberation characteristic, the sound from the wireless speaker 1 can give desired reverberation. For example, as desired reverberation, reverberation of all the speaker units 2 can be set to be the same. Hence, it is possible to prevent deterioration in sound quality due to sound or the like reflected from the wall, the ceiling, or the like as described with reference to FIG. 5.

Figure 8:
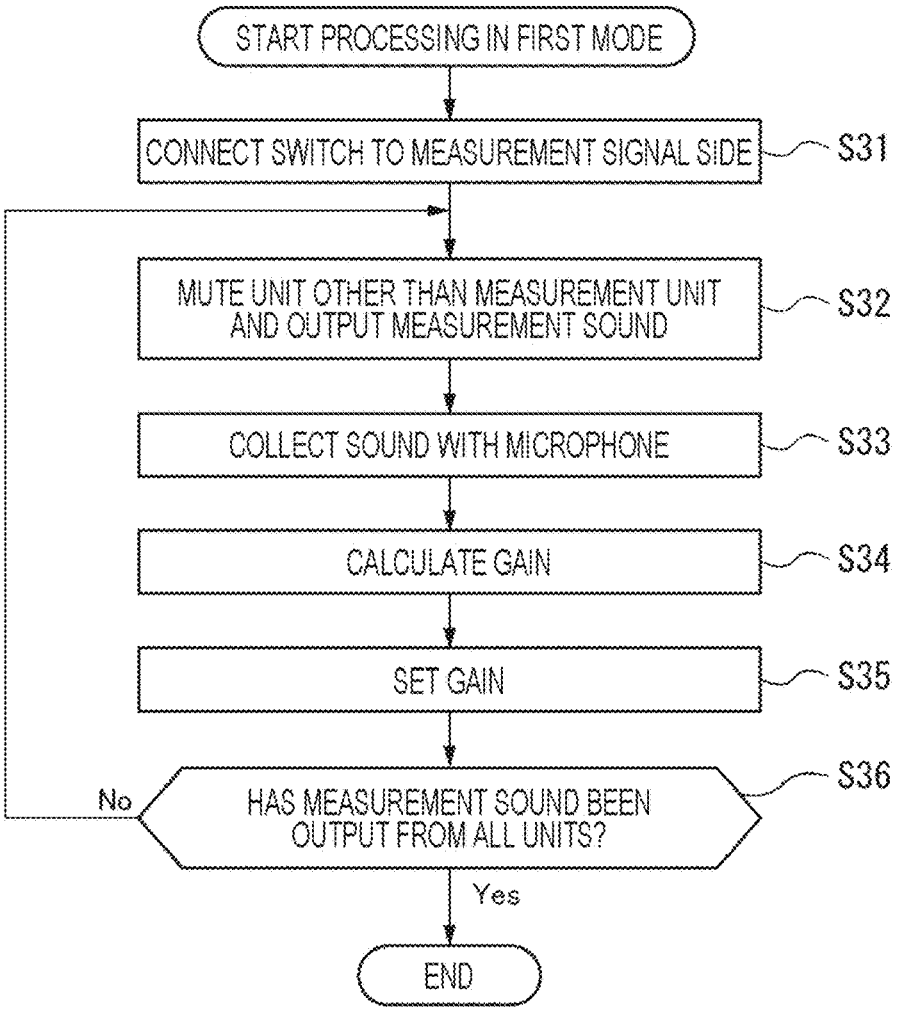
FIG. 8 is a flowchart for describing another operation of the audio output controller.

Note that the processing of the flowchart shown in FIG. 8 may be performed multiple times. For example, after the processing of the flowchart shown in FIG. 8 has been performed to set the gains for all the speaker units 2-1 to 2-4, the processing of the flowchart of FIG. 8 may be performed again with the set gains. As described above, gain may be adjusted more finely by performing the processing multiple times.

Also, in the case where the processing is performed multiple times, measurement sounds of different frequencies may be output, and a gain may be set for each of the measurement sounds of different frequencies. In this case, the gain may be switched according to the frequency of the audio signal at the time of reproduction of the audio signal.

Additionally, after setting the gain for each frequency, the average value of the multiple gains may be set as the final gain. <Configuration and Operation of Wireless Speaker in Second Mode>

Figure 9:
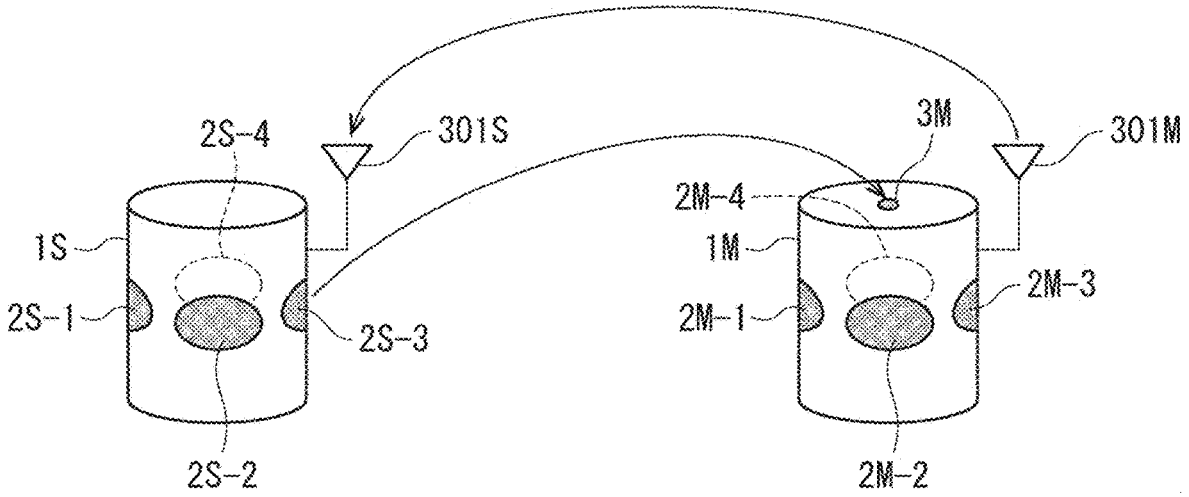
FIG. 9 is a diagram for describing the method of measuring reverberation.

FIG. 9 is a diagram showing a configuration example of a system including the wireless speaker 1 in the second mode (master-slave measurement mode).

The second mode is performed in a system including at least two wireless speakers 1, and is a mode in which a gain is set by outputting measurement sound from one wireless speaker 1 and collecting the measurement sound by the other wireless speaker 1. Hence, the system includes a wireless speaker 1M and a wireless speaker 1S as shown in FIG. 9, for example. In FIG. 9, the wireless speaker denoted by the reference sign "M" indicates the master (main), and the wireless speaker denoted by the reference sign "S" indicates the slave (sub).

Here, the wireless speaker 1 whose reverberation is to be measured is regarded as a slave, and is referred to as the wireless speaker 1S. Reverberation of the measurement target wireless speaker 1S is measured. The wireless speaker 1 whose the gain is set is regarded as a master, and is referred to as the wireless speaker 1M.

The wireless speaker 1S and the wireless speaker 1M shown in FIG. 9 have four speaker units 2 similarly to the wireless speaker 1 shown in FIG. 1. Additionally, at least the wireless speaker 1M on the master side includes the microphone 3. While the wireless speakers 10 and 20 shown in FIG. 2 and FIG. 3 are also usable, here, the description will be continued by taking the wireless speaker 1 shown in FIG. 1 as an example.

At the time of reverberation measurement, the wireless speaker 1S as the slave outputs measurement sound from the measurement target unit speaker 2S, and the microphone 3M of the wireless speaker 1M as the master collects the measurement sound. The wireless speaker 1M uses the collected measurement sound to calculate a reverberation characteristic or calculate a gain that achieves a desired reverberation characteristic.

Then, the wireless speaker 1M transmits the calculated gain (gain information) to the wireless speaker 1S. The wireless speaker 1S sets the gain of the measurement target unit speaker 2S on the basis of the gain information from the wireless speaker 1S.

By repeating such processing, the gain of each speaker unit 2S of the wireless speaker 1S is set.

The wireless speaker 1S and the wireless speaker 1M include an antenna 301S and an antenna 301M, respectively, in order to exchange gain information. The antenna 301 may be dedicated to exchange of gain information or may be also used as an antenna for receiving an audio reproduction signal.

Additionally, in a case where in the wireless speaker 1 in which the wireless speaker 1S and the wireless speaker 1M are paired, a signal such as a synchronization signal of reproduction time may be exchanged through the antenna 301.

Configurations of the wireless speaker 1S and the wireless speaker 1M differ depending on whether the slave-master relationship is maintained (fixed) or is switched.

Maintenance of the slave-master relationship refers to a case where the relationship is not changed when the measurement target is the slave and the gain calculation is done by the master as described with reference to FIG. 9.

Additionally, even in a system including multiple wireless speakers 1S as slaves, for example, a case where there is one wireless speaker 1M as the master and this wireless speaker 1M sequentially sets the gains of the multiple wireless speakers 1S is another example in which the slave-master relationship is maintained.

A case where the slave-master relationship is switchable is a case where, after the gain of the slave-side wireless speaker 1S is set as described with reference to FIG. 9, in order to set the gain of the master-side wireless speaker 1M, the master wireless speaker 1M is changed to the slave-side wireless speaker 1S and the slave wireless speaker 1S is changed to the master-side wireless speaker 1M to perform reverberation measurement processing.

First, the configurations of the slave-side wireless speaker 1S and the master-side wireless speaker 1M in the case where the slave-master relationship is maintained will be described with reference to FIGS. 10 and 11.

Figure 10:
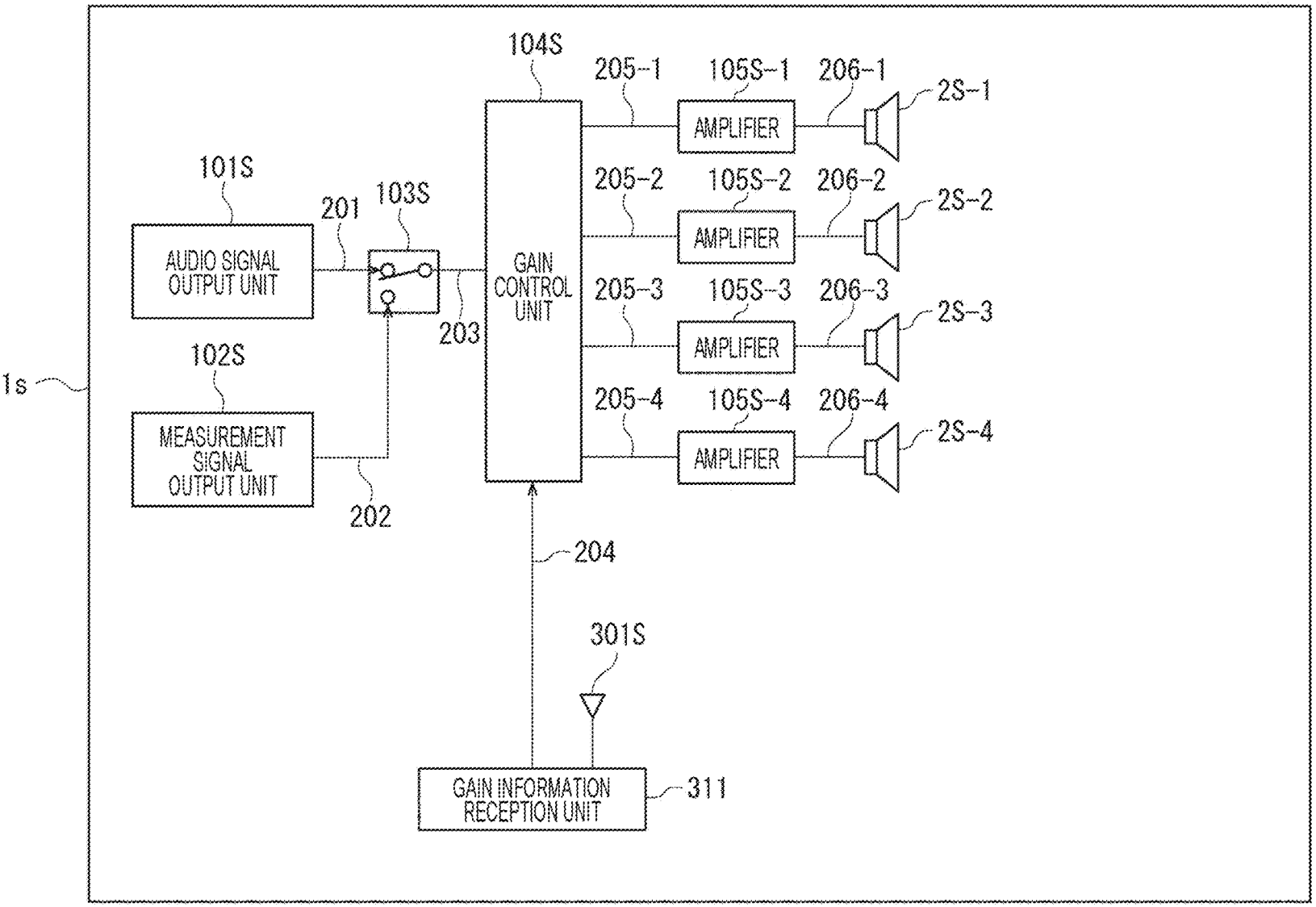
FIG. 10 is a diagram showing another internal configuration example of the audio output controller.

FIG. 10 is a diagram showing a configuration example of the slave-side wireless speaker 1S.

The wireless speaker 1S includes an audio signal output unit 1015, a measurement signal output unit 102S, a switch 103S, a gain control unit 104S, amplifiers 105S-1 to 105S-4, the antenna 301S, and a gain information reception unit 311. The wireless speaker 1S also includes speaker units 2S-1 to 2S-4.

The wireless speaker 1S differs from the wireless speaker 1 shown in FIG. 6 in that the gain determination unit 106 and the microphone 3 are eliminated, and that the antenna 301S and the gain information reception unit 311 are added. The other parts are similar to those of the wireless speaker 1 shown in FIG. 6, and similar parts are denoted by the same reference numeral with "S" added thereto while the description thereof are omitted as appropriate.

The audio signal output unit 1015 receives an audio signal transmitted from a server in a wirelessly connected network or another reproduction device, and outputs the audio reproduction signal 201 to the switch 103S.

Additionally, in a case where the wireless speaker 1S is paired with the wireless speaker 1M, the audio signal output unit 1015 also performs synchronization processing of reproduction timing with the paired wireless speaker 1M. The exchange of signals for synchronization when performing such processing and the reception of audio signals may be performed through the antenna 301S, or may be performed by providing another transceiver unit.

At the time of measuring the impulse response of the speaker unit 2S, the measurement signal output unit 102S outputs the measurement signal 202 to the switch 103S. The switch 103 switches between the audio reproduction signal 201 and the measurement signal 202, and outputs the reproduction signal 203 to the gain control unit 104S.

In the audio reproduction mode, the gain control unit 104S multiplies the reproduction signal 203 by the gain set in each of the speaker units 2S-1 to 2S-4 on the basis of the gain control information 204 supplied from the gain information reception unit 311, and generates the unit output signals 205-1 to 205-4.

Additionally, in the reverberation measurement mode, the gain control unit 104S sets the gain corresponding to the speaker unit 2S for measuring reverberation to 1, and sets the gain for the other speaker units 2 to 0 (mute).

The unit output signals 205-1 to 205-4 generated by the gain control unit 104S are supplied to the amplifiers 105S-1 to 105S-4, respectively and amplified, and then are supplied to the corresponding speaker units 2S-1 to 2S-4 to be output.

Figure 11:
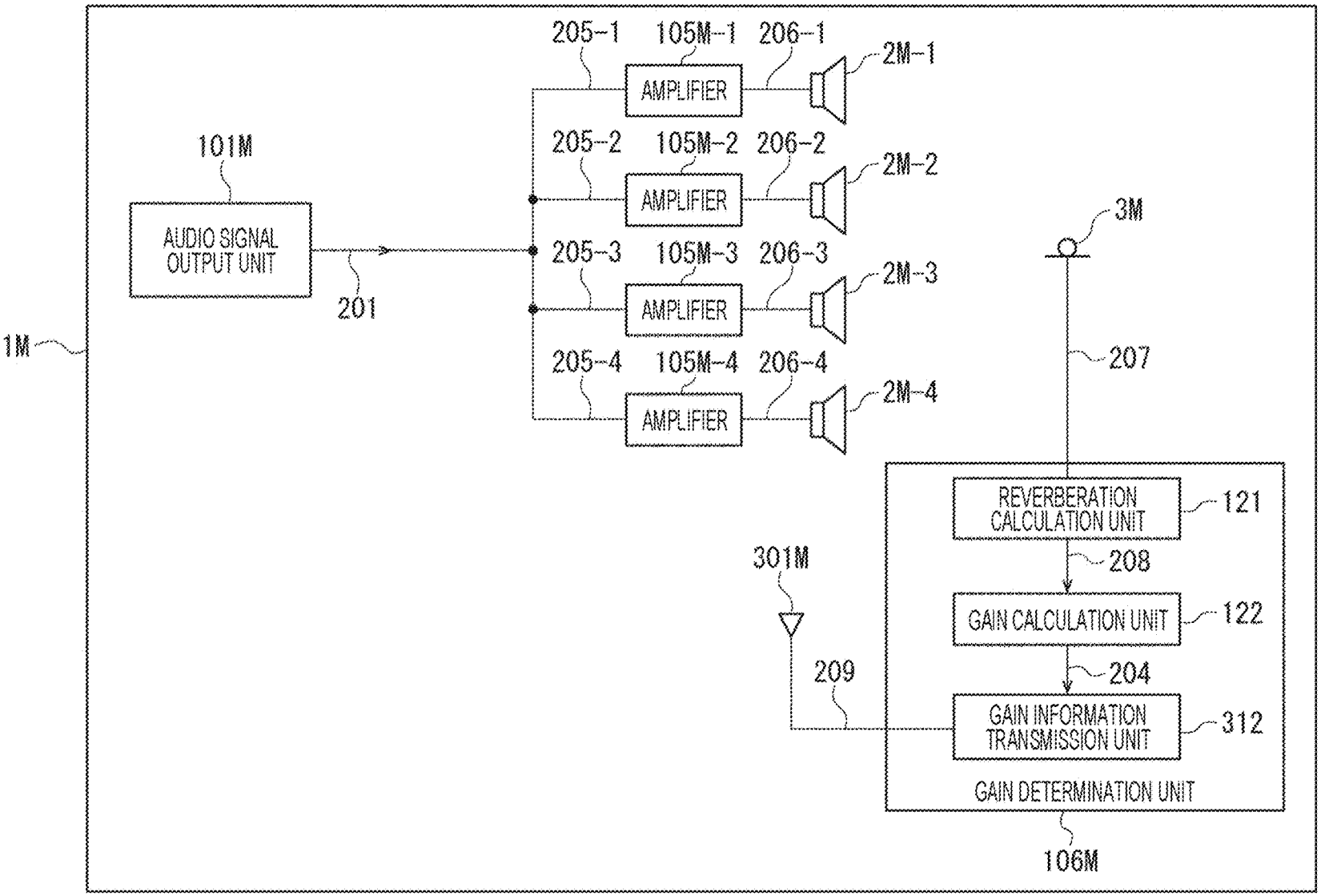
FIG. 11 is a diagram showing another internal configuration example of the audio output controller.

FIG. 11 is a diagram showing a configuration example of the master-side wireless speaker 1M.

The wireless speaker 1M includes an audio signal output unit 101M, amplifiers 105M-1 to 105M-4, a gain determination unit 106M, and the antenna 301M. The wireless speaker 1 also includes speaker units 2M-1 to 2M-4 and a microphone 3M.

The wireless speaker 1M differs from the wireless speaker 1 shown in FIG. 6 in that the measurement signal output unit 102, the switch 103, and the gain control unit 104 are eliminated, and that a gain information transmission unit 312 is added to the antenna 301M and the gain determination unit 106M. The other parts are similar to those of the wireless speaker 1 shown in FIG. 6, and similar parts are denoted by the same reference numeral with "M" added thereto while the description thereof are omitted as appropriate.

The wireless speaker 1M collects the measurement sound output from the wireless speaker 1S with the microphone 3M and performs processing of setting the gain by the gain determination unit 106M, but does not perform processing of outputting the measurement sound to another wireless speaker 1. Hence, the part that outputs the measurement sound is eliminated.

Note that with the configuration as shown in FIG. 11, the wireless speaker 1M itself cannot set the gain. For this reason, the wireless speaker 1M may be configured as the wireless speaker 1 shown in FIG. 6 and perform the processing described with reference to the flowchart in FIG. 8, that is, the processing related to the first mode (autonomous measurement mode) to set its own gain.

Thus, the embodiments can be applied in combination. That is, in this case, the wireless speaker 1M serving as the master can set its own gain in the first mode, and the gain of wireless speaker 1S serving as the slave can be set in the second mode (master-slave measurement mode). Additionally, it is also possible to combine the third mode (slave measurement mode) described later.

The description returns to the configuration of the wireless speaker 1M shown in FIG. 11. The audio signal output unit 101M of the wireless speaker 1M receives an audio signal transmitted from a server in a wirelessly connected network or another reproduction device, and supplies the audio signal to the amplification units 105M-1 to 105-4.

Additionally, in a case where wireless speaker 1M is paired with the wireless speaker 1S, the audio signal output unit 101M also performs synchronization processing of reproduction timing with the paired wireless speaker 1S. The exchange of signals such as synchronization signals when performing such processing and the reception of audio signals may be performed through the antenna 301M, or may be performed by providing another transceiver unit.

The gain determination unit 106M includes the reverberation calculation unit 121, the gain calculation unit 122, and the gain information transmission unit 312. The gain determination unit 106M is configured such that the gain information transmission unit 312 is added to the gain determination unit 106 of the wireless speaker 1 shown in FIG. 6.

The reverberation calculation unit 121 calculates the reverberation characteristic 208 from the measurement signal 207 collected by the microphone 3M, and supplies the reverberation characteristic 208 to the gain calculation unit 122. The gain calculation unit 122 calculates gain control information 204 of the speaker unit 2S of the measurement target wireless speaker 1S on the basis of the supplied reverberation characteristic 208, so as to obtain a desired reverberation characteristic.

The gain control information 204 is supplied to the gain information transmission unit 312, and is subjected to processing such as packetization for transmission from the antenna 301M to the wireless speaker 1S side.

The gain information transmission unit 312 generates a gain information packet 209 by performing predetermined processing on the gain control information 204, and transmits the gain information packet 209 to the wireless speaker 1S through the antenna 301M.

The configuration of the wireless speaker 1 in the case where the relationship between the slave and the master is switchable will be described.

Figure 12:
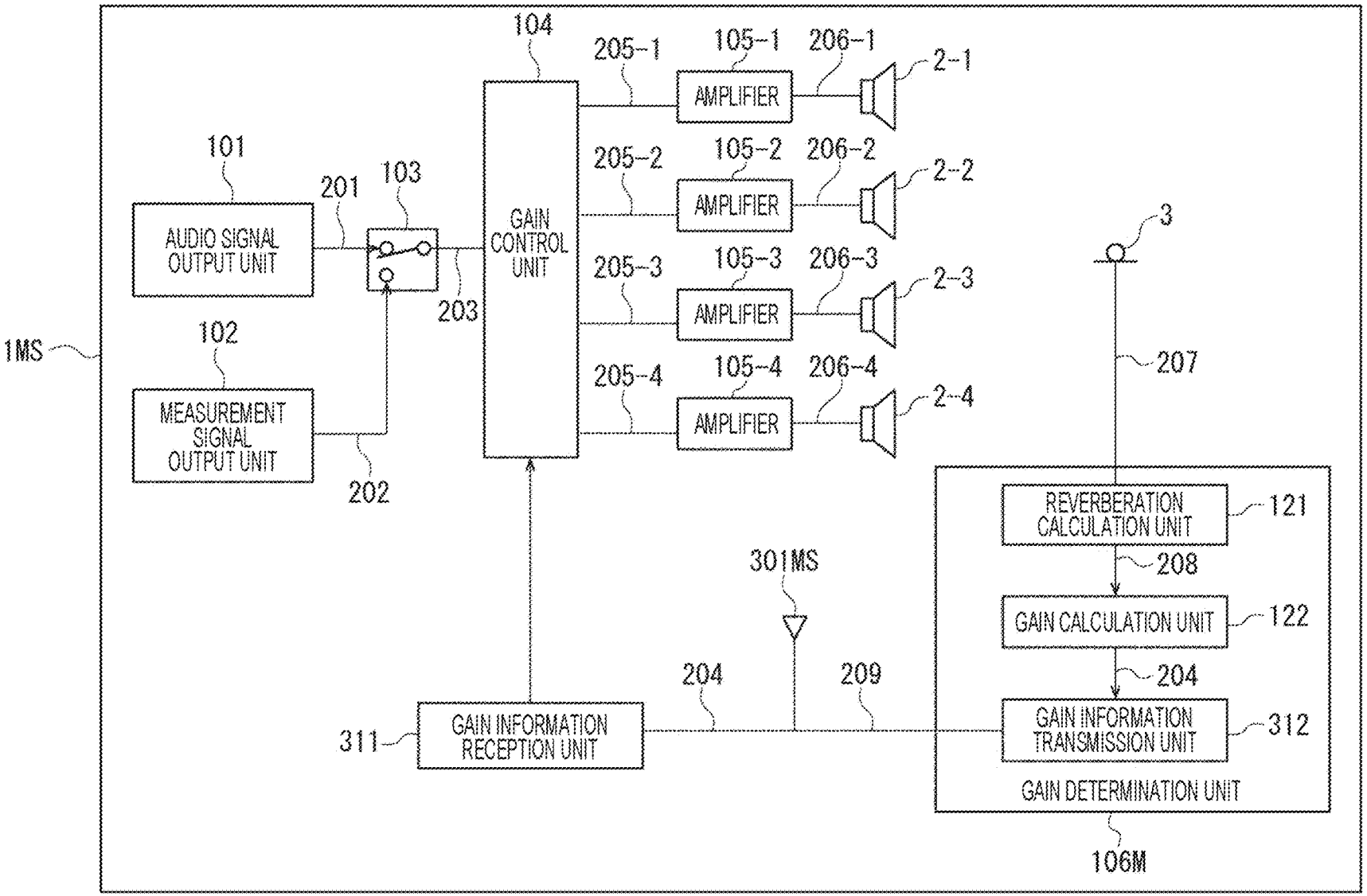
FIG. 12 is a diagram showing another internal configuration example of the audio output controller.

FIG. 12 is a diagram showing a configuration example of the wireless speaker 1 in the case where the relationship between the slave and the master is switchable.

Since the slave-master relationship is switchable, the wireless speaker 1 has the configuration of the wireless speaker 1S shown in FIG. 10 and the configuration of the wireless speaker 1M shown in FIG. 11. This configuration is substantially similar to the wireless speaker 1 shown in FIG. 6 that outputs a measurement sound by the wireless speaker 1 itself and executes the autonomous measurement mode for setting a gain.

A wireless speaker 1MS shown in FIG. 12 is configured such that an antenna 301MS is added to the wireless speaker 1 shown in FIG. 6. Additionally, the gain information reception unit 311 that processes gain information received through the antenna 301MS is provided, and the gain information transmission unit 312 that processes gain information to be transmitted through the antenna 301MS is provided.

In the wireless speaker 1MS shown in FIG. 12, the parts similar to those of the wireless speaker 1 shown in FIG. 6 are denoted by the same reference numerals, and the description thereof is appropriately omitted. Additionally, since the gain information reception unit 311 performs processing similar to that of the gain information reception unit 311 shown in FIG. 10, the same reference numeral is assigned, and the description thereof is appropriately omitted. In addition, since the gain information transmission unit 312 performs processing similar to that of the gain information transmission unit 312 shown in FIG. 11, the same reference numeral is assigned, and the description thereof is appropriately omitted.

When the wireless speaker 1MS shown in FIG. 12 operates as the slave-side wireless speaker 1, the function of the wireless speaker 1S shown in FIG. 10 is activated to perform processing of outputting measurement sound, receiving gain information from the master wireless speaker 1MS, and setting a gain in the gain control unit 104.

When the wireless speaker 1MS shown in FIG. 12 operates as the master-side wireless speaker 1, the function of the wireless speaker 1M shown in FIG. 11 is activated to perform processing of collecting measurement sound, calculating the gain of the slave wireless speaker 1MS using the collected measurement sound, and transmitting gain information.

The operation of the wireless speaker 1S shown in FIG. 10, the wireless speaker 1M shown in FIG. 11, and the wireless speaker 1MS shown in FIG. 12 will be described.

Figure 7:
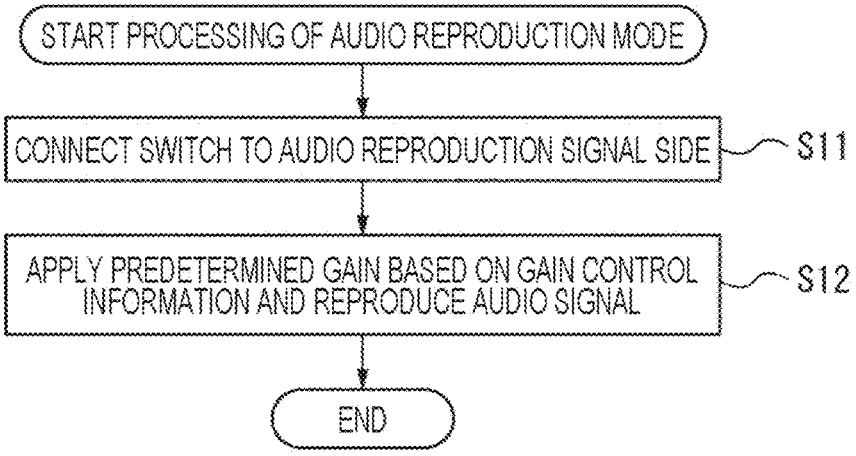
FIG. 7 is a flowchart for describing an operation of the audio output controller.

The processing performed by the wireless speaker 1S shown in FIG. 10, the wireless speaker 1M shown in FIG. 11, and the wireless speaker 1MS shown in FIG. 12 during audio reproduction mode is performed on the basis of the flowchart shown in FIG. 7, and therefore the description thereof is omitted.

The operation of the slave-side wireless speaker 1 will be described with reference to the flowchart shown in FIG. 13. In other words, the operation of the wireless speaker 1S shown in FIG. 10 or the operation when the wireless speaker 1MS shown in FIG. 12 operates as the slave-side wireless speaker 1 will be described. Here, the wireless speaker 1S shown in FIG. 10 will be described as an example.

In step S101, the switch 103S (FIG. 10) is connected to the measurement signal output unit 102S side. In step S102, the units other than the measurement unit are muted and measurement sound is output. The processing of steps S101 and S102 is performed in a similar manner as steps S31 and S32 of the flowchart shown in FIG. 8, and therefore detailed description thereof is omitted.

In step S103, the gain information packet 209 transmitted from the master-side wireless speaker 1M is received by the gain information reception unit 311 through the antenna 301S. The gain information reception unit 311 extracts gain information from the received gain information packet 209, generates the gain control information 204, and supplies the gain control information 204 to the gain control unit 104S.

In step S104, the gain control unit 104S sets the gain of the speaker unit 2S that outputs the measurement sound on the basis of the gain control information 204. Then, in step S105, it is determined whether or not measurement sound has been output from all the units.

In step S105, if there is a speaker unit 2S that has not yet output the measurement sound, the processing returns to step S102 and the subsequent processing is repeated, and in a case where it is determined that all the speaker units 2S have output the measurement sound, the slave-side processing is ended.

The processing of the master-side wireless speaker 1M corresponding to such a slave-side wireless speaker 1S will be described with reference to the flowchart of FIG. 14. In other words, the operation of the wireless speaker 1M shown in FIG. 11 or the operation when the wireless speaker 1MS shown in FIG. 12 operates as the master-side wireless speaker 1 will be described. Here, the wireless speaker 1M shown in FIG. 11 will be described as an example.

In step S131, the measurement sound is collected by the microphone 3M (FIG. 11). In step S132, the collected measurement sound is used to calculate the gain of the speaker unit 2S that outputs the measurement sound. The processing of step S131 and step S132 is performed in a similar manner as step S33 and step S34 of the flowchart shown in FIG. 8, and therefore detailed description thereof is omitted.

In step S133, the gain information transmission unit 312 generates the gain information packet 209 by performing predetermined processing on the gain control information 204 calculated by the gain calculation unit 122, and transmits the gain information packet 209 to the wireless speaker 1S side through the antenna 301M.

Thus, the gains of the multiple speaker units 2S provided in the wireless speaker 1S are set for each of the speaker units 2S. Thereafter, by changing the wireless speaker 1M set as the master to the slave-side wireless speaker 1S and changing the wireless speaker 1S set as the slave to the slave-side wireless speaker 1M and repeating similar processing, the gain can also be set for the wireless speaker 1M set as the master.

Alternatively, the wireless speaker 1M set as the master can set its own gain in the first mode (autonomous measurement mode).

Thus, the gains of the multiple speaker units 2S provided in the wireless speaker 1S are set for each of the speaker units 2S. Since the set gain is a gain that achieves a desired reverberation characteristic, the sound from the wireless speaker 1S can give desired reverberation. For example, as desired reverberation, reverberation of all the speaker units 2 can be set to be the same. Hence, it is possible to prevent deterioration in sound quality due to sound or the like reflected from the wall, the ceiling, or the like as described with reference to FIG. 5.

Additionally, the gain set by the second mode is a gain set by the wireless speaker 1M arranged in a distant position. It is considered that sound is often listened to in a position distant from the speaker that emits the sound rather than in the vicinity of the speaker that emits the sound. Hence, by calculating gain from measurement sound collected by the wireless speaker 1 located in a remote position, it is possible to further reduce the influence of reflected sound and reverberant sound and to set the gain for preventing deterioration in sound quality.

<Configuration and Operation of Wireless Speaker in Third Mode>

Next, a configuration example and an operation of the wireless speaker 1 in the third mode (slave measurement mode) will be described. In the third mode, reverberation measurement is performed by the wireless speaker 20 and the mobile terminal device 30 as shown in FIG. 4.

That is, in the third mode, the wireless speaker 20 functions as a slave and the mobile terminal device 30 functions as a master.

Since the wireless speaker 20 functions as a slave, a configuration similar to that of the wireless speaker 1S shown in FIG. 10 can be used. Here, the description will be continued assuming that the wireless speaker 20 has a configuration similar to the wireless speaker 1S shown in FIG. 10.

Figure 15:
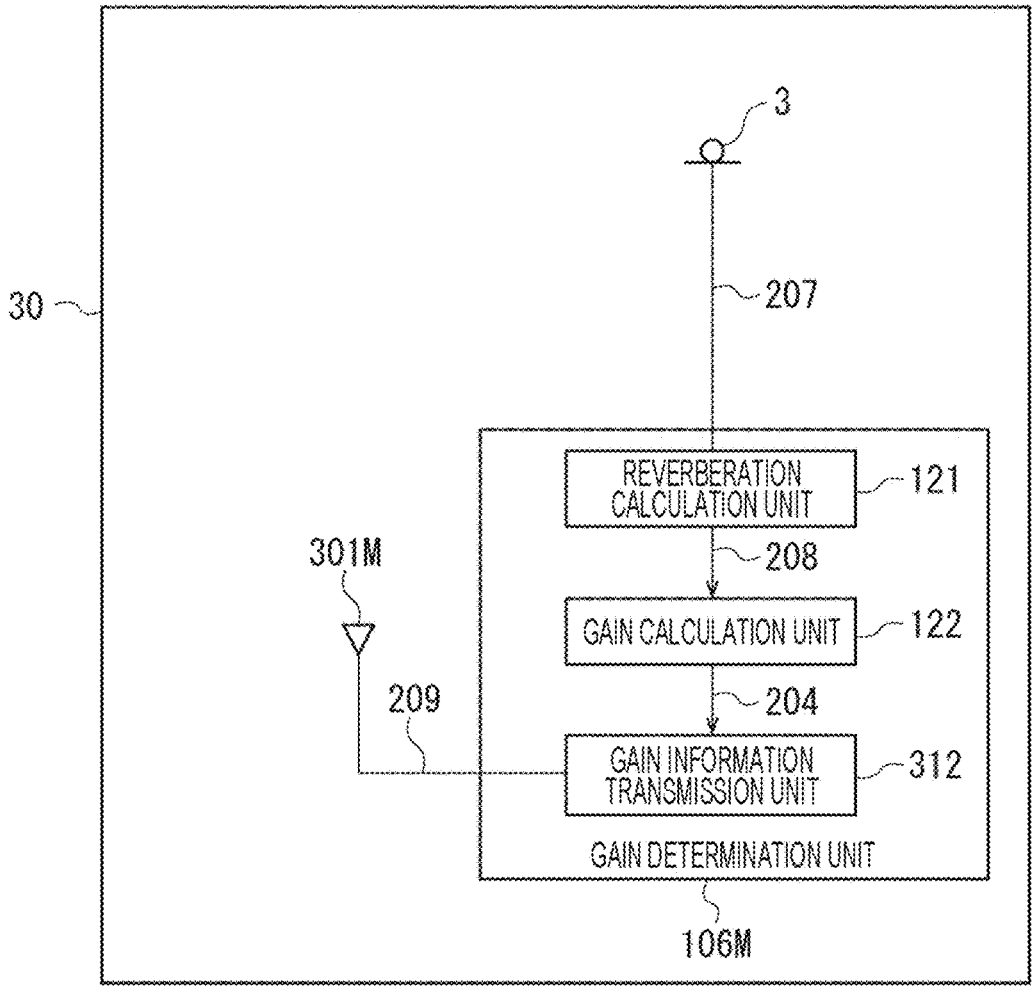
FIG. 15 is a diagram showing an internal configuration example of a mobile terminal device.

Functioning as a master, the mobile terminal device 30 has a function of collecting measurement sound and calculating gain. For example, the mobile terminal device 30 has a configuration shown in FIG. 15. The mobile terminal device 30 shown in FIG. 15 includes the gain determination unit 106M. The gain determination unit 106M is similar to the gain determination unit 106M included in the master-side wireless speaker 1M described with reference to FIG. 11.

The mobile terminal device 30 can be, for example, a smartphone, a tablet, or the like, and a microphone included in such a mobile terminal device 30 can be used as the microphone 3M.

Additionally, all or some of the functions of the gain determination unit 106M may be performed by an application. In a case where the functions are executed by such an application, the application can be installed in the existing mobile terminal device 30 to implement each function of the gain determination unit 106M of the present technology.

Figure 13:
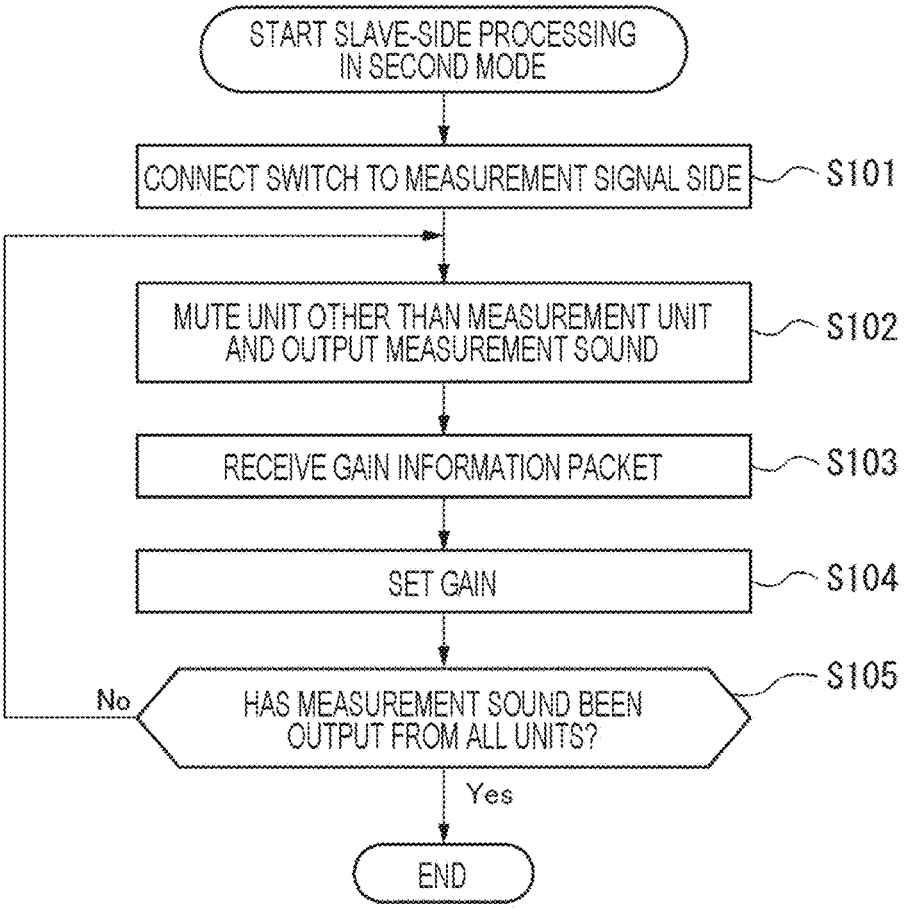
FIG. 13 is a flowchart for describing another operation of the audio output controller.

In the third mode, since the wireless speaker 20 functions as a slave-side wireless speaker, the operation is performed on the basis of the flowchart shown in FIG. 13. The operation performed on the basis of the flowchart shown in FIG. 13 has already been described, and therefore the description thereof is omitted.

Figure 14:
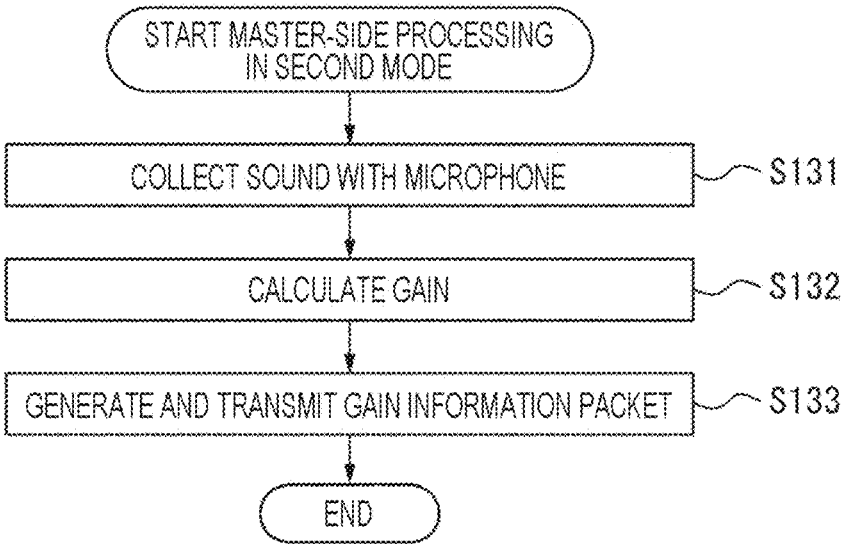
FIG. 14 is a flowchart for describing another operation of the audio output controller.

Additionally, in the third mode, the mobile terminal device 30 performs processing equivalent to that of the master-side wireless speaker in the second mode, and the operation is performed on the basis of the flowchart shown in FIG. 14. The operation performed on the basis of the flowchart shown in FIG. 14 has already been described, and therefore the description thereof is omitted.

Thus, the gains of the multiple speaker units 2 provided in the wireless speaker 20 are set for each of the speaker units 2. Since the set gain is a gain that achieves a desired reverberation characteristic, the sound from the wireless speaker 1 can give desired reverberation. For example, as desired reverberation, reverberation of all the speaker units 2 can be set to be the same. Hence, it is possible to prevent deterioration in sound quality due to sound or the like reflected from the wall, the ceiling, or the like as described with reference to FIG. 5.

Additionally, the gain set by the third mode is a gain set by the mobile terminal device 30 located in a distant position. For example, in a case where the mobile terminal device 30 is near the user, it is possible to set a gain for reducing the influence of reflected sound and reverberant sound at the user's listening point. Accordingly, it is possible to further reduce the influence of reflected sound and reverberant sound and to prevent deterioration in sound quality.

<Gain Setting>

Next, processing of setting the gain of the speaker unit 2 as described above, in other words, processing of the gain determination unit 106 will be described.

First, the reverberation characteristic calculated in the reverberation calculation unit 121 will be described. As the reverberation characteristic, an impulse response, a reverberation decay curve, a reverberation time, or the like can be used. The method of calculating a reverberation decay curve and a reverberation time will be described below.

First, in a case where a TSP signal is used as a measurement signal, an impulse response can be obtained by convolving an inverse TSP signal with the measurement signal 207 collected by the microphone 3 (FIG. 6). Assuming that the impulse response is h(t), a reverberation decay curve S(t) after time t is calculated by Schroeder integration as in the following equation (1).

[Expression 1]

$$S(t)=\int_t^{\infty} h^2(t)dt \quad (1)$$

Figure 16:
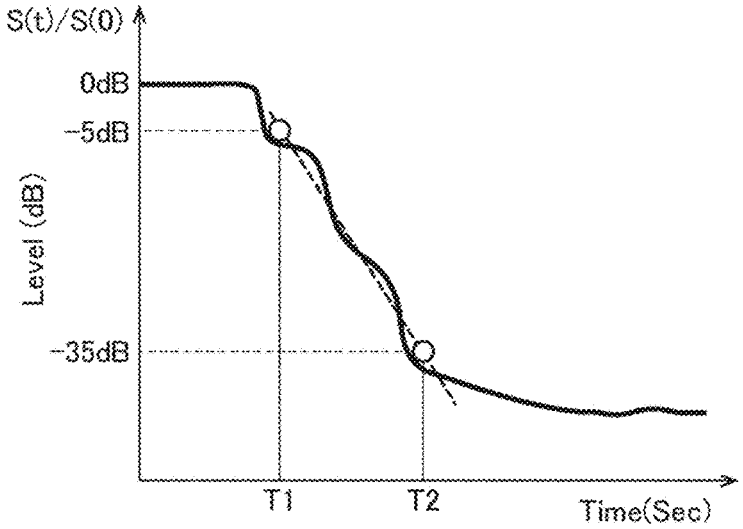
FIG. 16 is a diagram for describing a reverberation characteristic.

A reverberation time called RT60 is calculated from the reverberation decay curve S(t) expressed by the equation (1). RT60 refers to the time until the reverberation decay curve S(t) decays to 60 dB. FIG. 16 shows an example of the reverberation decay curve S(t), and shows an example of the reverberation decay curve S(t) normalized by S(0).

Referring to the graph shown in FIG. 16, due to the influence of initial reflection, fluctuation is large for the first few seconds, and reverberation does not decay much around the level of background noise of the room. Hence, in the calculation of the reverberation time RT60, estimation is made using a part where the reverberation decay curve S(t) decays linearly. For example, a linear regression coefficient of a 30 dB decay section with a reverberation level of −5 dB to −35 dB is calculated.

For example, assuming that the time of −5 dB on the approximated straight line is time T1 and the time of −35 dB is time T2, RT60 can be obtained by the following equation (2).

$$RT60=2\times(T2-T1) \quad (2)$$

Note that while the method of calculating the reverberation time from the impulse response has been described here as an example, the actual reverberation time differs depending on the frequency of the measurement signal. For example, measurement may be performed using pink noise or the like in which the band is narrowed instead of the TSP signal as a measurement signal, and reverberation characteristics (reverberation frequency characteristics) for each band may be determined and used as the reverberation characteristics. Additionally, the output signal of each speaker unit 2 may be divided into bands, and different gains may be calculated and controlled for each band.

Next, the method of setting the gain of the speaker unit 2 will be described. Here, by using the reverberation time RT60 as the reverberation characteristic, a method of determining the gain of each speaker unit 2 on the basis of the reverberation time RT60 will be described. Additionally, while the system (system which performs measurement in the second mode) shown in FIG. 9 is described here as an example, gain can be obtained similarly in other systems.

The table of FIG. 17 is an example of the reverberation time RT60 (seconds) of each speaker unit 2 calculated from the impulse response measured by the microphone 3M in the system configuration shown in FIG. 9. In the table shown in FIG. 17, the speaker units 2S-1 to 2S-4 of the wireless speaker 1S (slave side) are denoted as 2S-1, 2S-2, 2S-3, and 2S-4, respectively, and the speaker units 2M-1 to 2M-4 of the wireless speaker 1M (master side) are denoted as 2M-1, 2M-2, 2M-3, and 2M-4, respectively.

The reverberation time RT60 of the speaker unit 2S-1 is "2.2 seconds". The reverberation time RT60 of the speaker unit 2S-2 is "2.5 seconds". The reverberation time RT60 of the speaker unit 2S-3 is "1.5 seconds". The reverberation time RT60 of the speaker unit 2S-4 is "3.0 seconds".

The reverberation time RT60 of the speaker unit 2M-1 is "2.7 seconds". The reverberation time RT60 of the speaker unit 2M-2 is "3.5 seconds". The reverberation time RT60 of the speaker unit 2M-3 is "4.0 seconds". The reverberation time RT60 of the speaker unit 2M-4 is "2.0 seconds".

In a case where such measurement results are obtained, they are in the following order if arranged in increasing order of the reverberation time RT60.

2S-3<2M-4<2S-1<2S-2<2M-1<2S-4<2M-2<2M-3

The method of setting the gain of the speaker unit 2 will be described by taking as an example the case where such a measurement result (reverberation time RT60) is obtained.

<First Gain Setting Example>

Assuming that the desired reverberation time is zero (0), the gain of the speaker unit 2 having the largest difference from the reverberation time, in other words, having the maximum reverberation time, is suppressed for each wireless speaker 1.

For example, in a case where the measurement result as shown in FIG. 17 is obtained, of the speaker units 2S-1 to 2S-4 of the wireless speaker 1S, the speaker unit 2S-4 has the maximum reverberation time. Hence, the gain of the speaker unit 2S-4 is suppressed.

Additionally, of the speaker units 2M-1 to 2M-4 of the wireless speaker 1M, the speaker unit 2M-3 has the maximum reverberation time. Hence, the gain of the speaker unit 2M-3 is suppressed.

The suppression of gain means setting the gain of the corresponding speaker unit 2 to mute (gain=0) and setting the gains of the other speaker units 2 to 1, for example.

Note that instead of muting, the gain may be reduced to a small value of 1 or less. Additionally, the gain of the speaker unit 2 to be suppressed may be set smaller than the gain of the speaker unit 2 not to be suppressed.

Additionally, the gain may be suppressed not only for the speaker unit 2 having the maximum reverberation time but also for a predetermined number of (for example two) speaker units 2 having the next largest reverberation time.

However, since muting the gains of multiple speaker units 2 may eliminate the feeling of sound spreading, as an example with no reduction in the sound spreading feeling, the description will be continued by taking as an example the case where only the speaker unit 2 having the maximum reverberation time is muted.

In this case, as shown in the setting example 1 of FIG. 18, the gain of the speaker unit 2S-4 is set to mute (gain=0), and the other speaker units 2S-1 to 2S-3 are set to gain=1. In addition, similarly, the gain of the speaker unit 2M-3 is set to mute (gain=0), and the other speaker units 2M-1, 2M-2, and 2M-4 are set to gain=1.

In this manner, the gains can be set by adjusting the gain of the speaker unit 2 having the largest difference (or multiple speaker units 2 having the next largest differences) from the desired reverberation characteristic among the multiple speaker units 2.

<Second Gain Setting Example

The first gain setting example has been described by taking, as an example, the case where there are multiple wireless speakers 1 in the system (a system including only one wireless speaker 1 may be used), and the speaker unit 2 whose gain is to be suppressed independently is determined for each of the wireless speakers 1.

As a second gain setting example, a description will be given of a case where there are multiple paired wireless speakers 1, and settings are made to suppress the gain of the speaker unit 2 having the maximum reverberation time in the entire system including the multiple paired wireless speakers 1.

For example, in the example of FIG. 17, the wireless speaker 2S having the maximum measured reverberation time is the speaker unit 2S-4, and the reverberation time is 3.0 seconds.

When viewed as an entire system, that is, in this case, the wireless speaker 2S and the wireless speaker 2M, there is a speaker unit 2 whose reverberation time is longer than 3.0 seconds which is the maximum reverberation time of the wireless speakers 2S.

In the example shown in FIG. 17, the reverberation time of the wireless speaker 2M-2 and the wireless speaker 2M-3 is 3.5 seconds and 4.0 seconds, respectively, which is longer than 3.0 seconds which is the maximum reverberation time of the wireless speakers 2S.

In a case where the gain of the speaker unit 2 having the maximum reverberation time is suppressed for each wireless speaker 1, the gain of the speaker unit 2S-4 of the wireless speaker 1S is suppressed, and the gain of the speaker unit 2M-3 of the wireless speaker 1M is suppressed as described as the first gain setting example.

However, in this case, the speaker unit 2M-3 and the speaker unit 2M-2 of the wireless speaker 1M having longer remaining distance time than the speaker unit 2S-4 when viewed as an entire system may have a larger adverse effect on the sound quality at the user's listening point.

That is, when viewed as an entire system, sometimes it may be better to adjust the gain of the speaker unit 2 that will have a greater effect in the system than to adjust the gain of the speaker unit 2 having a large difference from the desired reverberation characteristic for each wireless speaker 1.

Accordingly, the gain may be adjusted so as to suppress the gains of multiple speaker units 2 having a long reverberation time when viewed as an entire system.

Here, a case where the gains of top two speaker units 2 having a long reverberation time in the system are suppressed will be described as an example. In a case where the measurement result as shown in FIG. 17 is obtained, the top two speaker units 2 having a long reverberation time are the speaker unit 2M-3 (reverberation time 4.0 seconds) and the speaker unit 2M-2 (reverberation time 3.5 seconds).

Hence, in this case, as shown in the setting example 2 of FIG. 18, the gains of the speaker unit 2M-2 and the speaker unit 2M-3 are set to 0, and the gains of the other speaker units 2 are set to 1.0.

The number of speaker units 2 whose gain is adjusted can be a number corresponding to a predetermined ratio, such as 25%, of the number of speaker units 2 present in the system, for example. For example, in the system shown in FIG. 9, since eight speaker units 2 exist, 25%, that is, two speaker units 2 are targeted for gain adjustment.

As described above, in a system in which multiple wireless speakers 1 exist, the gains of multiple speaker units 2 having a large difference from the desired reverberation characteristic among the speaker units 2 included in the multiple wireless speakers 1 can be adjusted. Additionally, the number of the speaker units 2 to be adjusted may be one or more.

<Third Gain Setting Eample>

In the first gain setting example and the second gain setting example, it has been assumed that the desired reverberation time is 0. However, in music, for example, sometimes it is better to have appropriate reverberation like a concert hall.

Hence, as a third gain setting example, a description will be given by taking, as an example, a case where settings are made to suppress the gain according to the difference from the desired reverberation time or the amount exceeding the desired reverberation time.

Note, however, that since the speaker unit 2 having a reverberation time smaller than the desired reverberation time has less influence on the overall reverberation, here, the case of suppressing the gain of the speaker unit 2 having a reverberation time larger than the desired reverberation time is taken as an example.

For example, assuming that the measured reverberation time of the speaker unit 2 is T, the desired reverberation time is Td, and the gain of each speaker unit 2 is Gain, the gain is set by the following function (3). Additionally, FIG. 19 shows a diagram in the case where the equation (3) is represented by a graph. Note that k is an attenuation coefficient of a gain, and is a value of about several seconds.

[Expression 2]

$$\begin{aligned} &T \leqq T_d && \text{Gain} = 1.0 \\ &Td < T \leqq Td + k && \text{Gain} = 1 - \frac{(T - Td)}{k} \\ &T > Td + k && \text{Gain} = 0 \end{aligned} \tag{3}$$

In a case where the gain is set on the basis of the equation (3), if the reverberation time T of the speaker unit 2 is equal to or less than the desired reverberation time Td, the gain of the speaker unit 2 is set to 1.0.

If the reverberation time T of the speaker unit 2 is larger than the desired reverberation time Td and equal to or less than the time obtained by adding the attenuation coefficient k to the desired reverberation time Td, the gain of the speaker unit 2 is set to a value obtained by subtracting the desired reverberation time Td from the reverberation time T, dividing this value by the attenuation coefficient k, and subtracting this value from 1.

In this section, as shown in FIG. 19, the gain is set on the basis of a linear function. Additionally, in this section, the gain is set to a value smaller than one.

In a case where the reverberation time T of the speaker unit 2 is larger than the desired reverberation time Td, the gain of the speaker unit 2 is set to 0 (mute).

For example, the gain setting examples in a case where the desired reverberation time Td is 2.5 seconds, the attenuation coefficient k is 2, and the measurement results shown in FIG. 17 are obtained are shown in the setting example 3 of FIG. 18.

Since the reverberation time T of each of the speaker unit 2S-1, the speaker unit 2S-2, the speaker unit 2S-3, and the speaker unit 2M-4 is equal to or less than the desired reverberation time Td=2.5 seconds, the gain is set to 1.0.

Since the reverberation time T of each of the speaker unit 2S-4, the speaker unit 2M-1, the speaker unit 2M-2, and the speaker unit 2M-3 is larger than the desired reverberation time Td=2.5 seconds, and equal to or less than the value 4.5 seconds obtained by adding the attenuation coefficient k to the desired reverberation time Td, according to the equation, the gains are set to 0.75, 0.9, 0.5, and 0.25, respectively.

Thus, the gain may be adjusted according to the difference from the desired reverberation characteristic. Additionally, the gain may be adjusted on the basis of a predetermined function. Additionally, the predetermined function can be a linear function.

<Fourth Gain Setting Example>

While the gain may be set on the basis of the equation (3) (a function in which a part is a linear function as shown in FIG. 19) as in the third gain setting example, the gain may be set by other functions.

In the fourth gain setting example, the gain is set by an exponential function. For example, assuming that the reverberation time of the predetermined speaker unit 2 is T, the desired reverberation time is Td, and the gain of each speaker unit 2 is Gain, the gain is set by the following function (4). Additionally, FIG. 20 shows a diagram in the case where the equation (4) is represented by a graph. Note that, r is an attenuation coefficient of a gain, and is a value of about several seconds.

[Expression 3]

$$T \leq Td \text{ Gain}=1.0$$

$$T > Td \text{ Gain}=\exp\{-r\times(T-Td)\} \quad (4)$$

In a case where the gain is set on the basis of the equation (4), if the reverberation time T of the speaker unit 2 is equal to or less than the desired reverberation time Td, the gain of the speaker unit 2 is set to 1.0.

If the reverberation time T of the speaker unit 2 is larger than the desired reverberation time Td, the gain of the speaker unit 2 is set to a value obtained by subtracting the desired reverberation time Td from the reverberation time T, multiplying this value by the attenuation coefficient r, and finding the value of the negative exponential function of this value.

Thus, it is also possible to set the gain using an exponential function. Additionally, although a linear function and an exponential function have been described as examples, it is also possible to use other functions to set the gain.

<Fifth Gain Setting Example>

As a fifth gain setting example, only the speaker unit 2 having the maximum difference from the desired reverberation time Td or amount exceeding the desired reverberation time Td is adjusted according to the predetermined function depending on the exceeded amount.

For example, in a case where the measurement result as shown in FIG. 17 is obtained, and the desired reverberation time Td=2.5 seconds, the speaker unit 2 having the maximum reverberation time exceeding the desired reverberation time Td in each wireless speaker 1 is the speaker unit 2S-4 (3.0 seconds) in the wireless speaker 1S, and the speaker unit 2M-3 (4.0 seconds) in the wireless speaker 1M.

The gains are set for the two speaker units 2 using the predetermined function described as the third gain setting example or the fourth gain setting example. For example, in a case where the gains are adjusted for the speaker unit 2S-4 and the speaker unit 2M-3 having the maximum measured reverberation time exceeding the desired reverberation time Td by applying the gain setting example shown in FIG. 3 (function shown in FIG. 19), the gains of the speaker units 2 are set to the gains as shown in the setting example 5 of FIG. 18.

Referring to FIG. 18, the gain of the speaker unit 2S-4 is set to "0.75", and the gain of the speaker unit 2M-3 is set to "0.25".

Thus, the gain can be set for the speaker unit 2 having the maximum difference from the desired reverberation time Td or amount exceeding the desired reverberation time Td by using a predetermined function such as a linear function or an exponential function.

Note that the fifth gain setting example is a setting example for suppressing the gain of the speaker unit 2 having the largest difference from the desired reverberation characteristic for each wireless speaker 1, as in the first gain setting example.

While the first gain setting example suppresses the gain by muting (gain=0), the fifth gain setting example is a case where the gain is set to a value other than 0, and the value is set by a predetermined function.

In the fifth gain setting example, the gain is set for each wireless speaker 1 as an example. However, as in the second gain setting example, it may be configured such that the gain of the speaker unit 2 having the largest difference (or multiple speaker units 2 in the order of the largest difference) from the desired reverberation characteristic is suppressed when viewed as an entire system.

In the fifth gain setting example, as in the second gain setting example, the gains of multiple speaker units 2 may be set in descending order of the difference from the desired reverberation characteristic.

<Sixth Gain Setting Example>

The above gain setting examples have been described by using reverberation time as the reverberation characteristic. As a sixth gain setting example, the gain may be set using information other than the reverberation time as the reverberation characteristic.

For example, a measured impulse response or reverberation decay curve may be used as the reverberation characteristic. Additionally, for example, in a case where an impulse response or a reverberation decay curve is used as the reverberation characteristic, data measured in a concert hall or the like may be used as the desired impulse response or the desired reverberation decay curve.

For example, the distance between the desired impulse response and the impulse response of each speaker unit 2 may be obtained, and the gain may be set according to the distance in a similar manner as in the above setting examples in which the reverberation time is used as the reverberation characteristic.

<Seventh Gain Setting Example>

As a seventh gain setting example, the gain of each speaker unit 2 may be set such that an error between the reverberation characteristic synthesized as a linear sum of the impulse response of each speaker unit 2 of the wireless speaker 1 and the desired reverberation characteristic is minimized.

In the case of setting the gain of each speaker unit 2 so as to minimize the error between the reverberation characteristic synthesized as a linear sum of the impulse response and the desired reverberation characteristic, a general solution of the least squares method can be used to calculate a gain that minimizes the error.

<Eighth Gain Setting Example>

As an eighth gain setting example, a reverberation decay curve may be used as the reverberation characteristic, and similar to the seventh gain setting example, the gain of each speaker unit 2 may be set such that an error between the reverberation characteristic synthesized as a linear sum of each speaker unit 2 and the desired reverberation characteristic is minimized.

Additionally, in the case of setting the gain of each speaker unit 2 such that the error between the reverberation characteristic synthesized as the linear sum of each speaker unit 2 and the desired reverberation characteristic is minimized as in the seventh gain setting example, a general solution of the least squares method can be used to calculate a gain that minimizes the error.

Note that while the first to eighth gain setting examples have been exemplified herein, the gain may be set on the basis of one of the first to eighth gain setting examples, or the gain may be set by combining multiple setting examples of the first to eighth gain setting examples.

Note that the gain may be set by a method other than the gain setting methods exemplified herein. For example, which characteristic to use as the reverberation characteristic, and how to adjust the gain from the measured reverberation characteristic may be determined by methods other than the above-described method.

According to the present technology, in wireless speakers (a system including multiple wireless speakers), it is possible to adjust the gain of sound reproduced from the speaker unit of each wireless speaker. Additionally, the adjustment can be made such that the reverberation characteristic achieves desired reverberation.

Further, according to the present technology, it is possible to suppress excess reverberation and reflection and provide sound with the sound quality desired by the user, without the user having to arrange the wireless speaker and perform adjustment after the arrangement so that the reverberation characteristics and the like become the user's desired characteristics.

<Recording Medium>

The above-described series of processing may be performed by hardware or software. In a case where the series of processing is performed by software, a program that is included in the software is installed on a computer. Here, the computer includes a computer incorporated in dedicated hardware, a general-purpose personal computer, for example, that can execute various functions by installing various programs, and the like.

Figure 21:
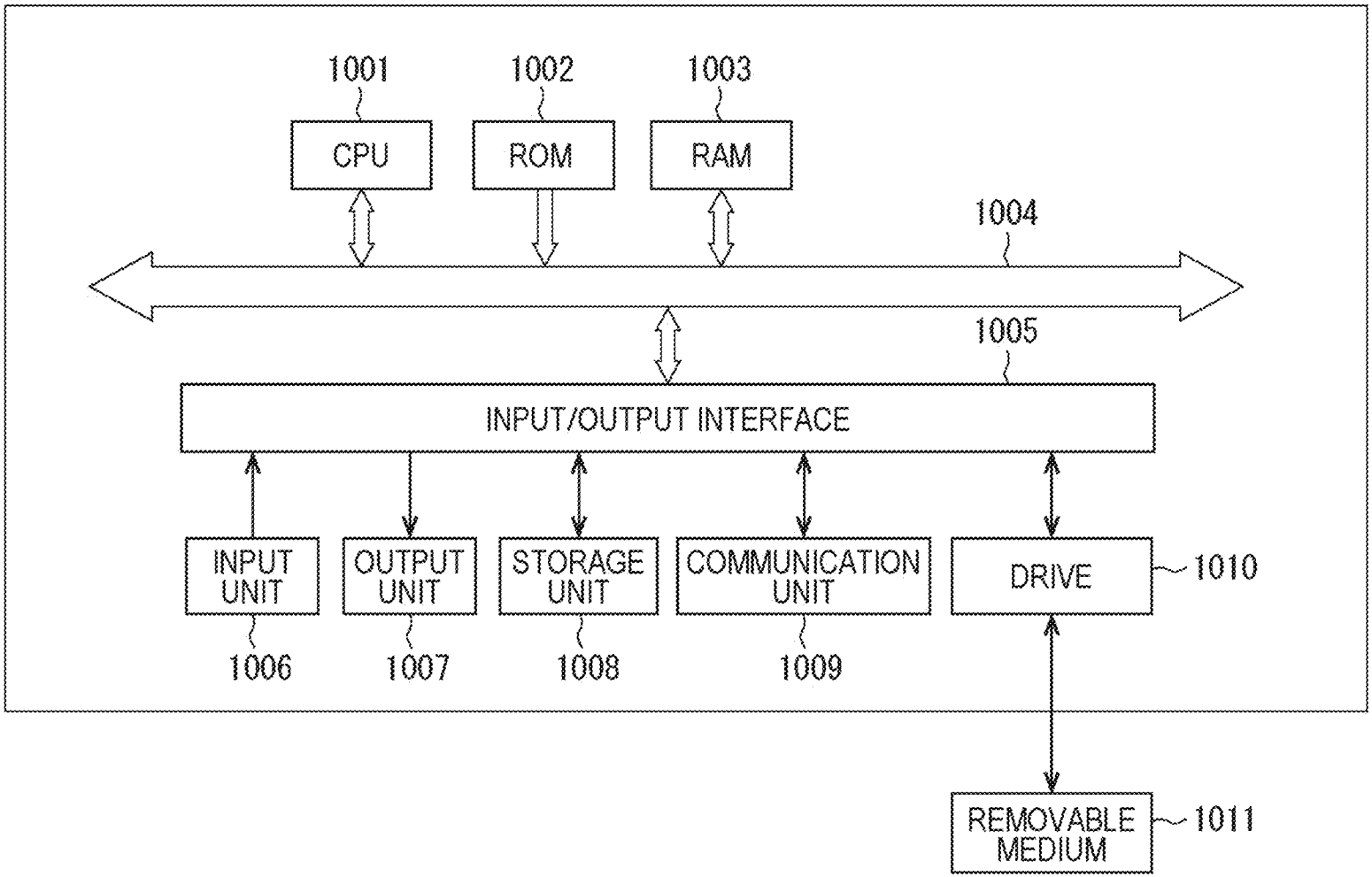
FIG. 21 is a diagram for describing recording media.

FIG. 21 is a block diagram showing a configuration example of hardware of a computer that executes the above-described series of processing by a program. In a computer, a central processing unit (CPU) 1001, a read only memory (ROM) 1002, and a random access memory (RAM) 1003 are mutually connected by a bus 1004. An input/output interface 1005 is also connected to the bus 1004. An input unit 1006, an output unit 1007, a storage unit 1008, a communication unit 1009, and a drive 1010 are connected to the input/output interface 1005.

The input unit 1006 includes a keyboard, a mouse, a microphone, and the like. The output unit 1007 includes a display, a speaker, and the like. The storage unit 1008 includes a hard disk, a nonvolatile memory, and the like. The communication unit 1009 includes a network interface and the like. The drive 1010 drives a removable medium 1011 such as a magnetic disk, an optical disk, a magneto-optical disk, or a semiconductor memory.

In the computer configured as described above, for example, the CPU 1001 loads a program stored in the storage unit 1008 to the RAM 1003 through the input/output interface 1005 and the bus 1004, and executes the above-described series of processing.

The program executed by the computer (CPU 1001) can be provided by being recorded on the removable medium 1011 such as a package medium. Additionally, the program can be provided through a wired or wireless transmission medium such as a local area network, the Internet, or digital satellite broadcasting.

In the computer, the program can be installed in the storage unit 1008 through the input/output interface 1005 by attaching the removable medium 1011 to the drive 1010. Additionally, the program can be received by the communication unit 1009 through a wired or wireless transmission medium and be installed in the storage unit 1008. In addition, the program can be installed in advance in the ROM 1002 or the storage unit 1008.

Note that the program executed by the computer may be a program that performs processing in chronological order according to the order described in the present specification, or a program that performs processing in parallel, or at a necessary timing such as when a call is made.

Additionally, in the present specification, a system represents an entire apparatus including multiple devices.

Note that the effect described in the present specification is merely an example and is not limited, and other effects can be obtained.

Note that the embodiments of the present technology are not limited to the above-described embodiments, and various modifications can be made without departing from the scope of the present technology.

Note that the present technology can also have the following configurations.

(1)

An audio output controller including multiple speaker units installed so as to face different directions, in which measurement sound is output from at least one speaker unit of the multiple speaker units, and a gain of the speaker unit is controlled on the basis of a reverberation characteristic when the measurement sound is measured by a microphone in a predetermined position.

(2)

The audio output controller according to (1) further including the microphone, in which the measurement sound output from a speaker unit installed in another audio output controller is measured by the microphone.

(3)

The audio output controller according to (1) further including the microphone, in which the measurement sound output from an installed speaker unit is measured by the microphone.

(4)

The audio output controller according to any one of (1) to (3), in which a gain is adjusted for a speaker unit having a largest difference from a desired reverberation characteristic among the multiple speaker units.

(5)

The audio output controller according to any one of (1) to (3), in which a gain is adjusted for each of multiple speaker units having a large difference from a desired reverberation characteristic among the multiple speaker units.

(6)

The audio output controller according to any one of (1) to (5), in which a gain is adjusted for one or multiple speaker units having a large difference from a desired reverberation characteristic among the speaker units installed in each of multiple audio output controllers.

(7)

The audio output controller according to any one of (1) to (6), in which a gain is adjusted according to a difference from a desired reverberation characteristic, and the adjustment is made on the basis of a predetermined function.

(8)

The audio output controller according to (7), in which the predetermined function includes a linear function or an exponential function.

(9)

The audio output controller according to any one of (1) to (8), in which the reverberation characteristic includes a reverberation time.

(10)

The audio output controller according to any one of (1) to (9), in which the reverberation characteristic includes an impulse response, and a gain is adjusted according to a distance between a desired impulse response and a measured impulse response.

(11)

The audio output controller according to any one of (1) to (10), in which the reverberation characteristic includes an impulse response, and a gain is adjusted according to a distance from a linear sum of impulse response measured by respective measurement sounds from the multiple speaker units.

(12)

The audio output controller according to any one of (1) to (11), in which the reverberation characteristic includes a reverberation decay curve, and a gain is adjusted so as to minimize an error between a reverberation characteristic synthesized as a linear sum of impulse response measured by the respective measurement sounds from the multiple speaker units and a desired reverberation characteristic.

(13)

An audio output control method of an audio output controller including multiple speaker units installed so as to face different directions, the method including the steps of:

outputting measurement sound from at least one speaker unit of the multiple speaker units; and controlling a gain of the speaker unit on the basis of a reverberation characteristic when the measurement sound is measured by a microphone in a predetermined position.

(14)

A program for causing a computer that controls an audio output controller including multiple speaker units installed so as to face different directions to perform processing including the steps of:

outputting measurement sound from at least one speaker unit of the multiple speaker units; and controlling a gain of the speaker unit on the basis of a reverberation characteristic when the measurement sound is measured by a microphone in a predetermined position.

REFERENCE SIGNS LIST

1 Wireless speaker
2 Speaker unit
3 Microphone
10, 20 Wireless speaker
30 Mobile terminal device
101 Audio signal output unit
102 Measurement signal output unit
103 Switch
104 Gain control unit
105 Amplifier
106 Gain determination unit
121 Reverberation calculation unit
122 Gain calculation unit

The invention claimed is:

1. An audio output controller comprising multiple speaker units installed so as to face different directions, wherein measurement sound is output from at least one speaker unit of the multiple speaker units, a gain of the speaker unit is controlled on a basis of a reverberation characteristic when the measurement sound is measured by a microphone in a predetermined position, the reverberation characteristic includes an impulse response, and a gain is adjusted according to a distance from a linear sum of impulse response measured by respective measurement sounds from the multiple speaker units.

2. The audio output controller according to claim 1 further comprising the microphone, wherein the measurement sound output from a speaker unit installed in another audio output controller is measured by the microphone.

3. The audio output controller according to claim 1 further comprising the microphone, wherein the measurement sound output from an installed speaker unit is measured by the microphone.

4. The audio output controller according to claim 1, wherein a gain is adjusted for a speaker unit having a largest difference from a desired reverberation characteristic among the multiple speaker units.

5. The audio output controller according to claim 1, wherein a gain is adjusted for each of multiple speaker units having a large difference from a desired reverberation characteristic among the multiple speaker units.

6. The audio output controller according to claim 1, wherein a gain is adjusted for one or multiple speaker units having a large difference from a desired reverberation characteristic among the speaker units installed in each of multiple audio output controllers.

7. The audio output controller according to claim 1, wherein a gain is adjusted according to a difference from a desired reverberation characteristic, and the adjustment is made on a basis of a predetermined function.

8. The audio output controller according to claim 7, wherein the predetermined function includes a linear function or an exponential function.

9. The audio output controller according to claim 1, wherein the reverberation characteristic includes a reverberation time.

10. The audio output controller according to claim 1, wherein the reverberation characteristic includes an impulse response, and a gain is adjusted according to a distance between a desired impulse response and a measured impulse response.

11. An audio output controller comprising multiple speaker units installed so as to face different directions, wherein measurement sound is output from at least one speaker unit of the multiple speaker units, a gain of the speaker unit is controlled on a basis of a reverberation characteristic when the measurement sound is measured by a microphone in a predetermined position, the reverberation characteristic includes a reverberation decay curve, and a gain is adjusted so as to minimize an error between a reverberation characteristic synthesized as a linear sum of impulse response measured by the respective measurement sounds from the multiple speaker units and a desired reverberation characteristic.

12. An audio output control method of an audio output controller including multiple speaker units installed so as to face different directions, the method comprising:

outputting measurement sound from at least one speaker unit of the multiple speaker units; and controlling a gain of the speaker unit on a basis of a reverberation characteristic when the measurement sound is measured by a microphone in a predetermined position, wherein the reverberation characteristic includes an impulse response, and a gain is adjusted according to a distance from a linear sum of impulse response measured by respective measurement sounds from the multiple speaker units.

13. A non-transitory computer readable medium containing instructions that, when executed by a computer, control an audio output controller including multiple speaker units installed so as to face different directions to perform processing comprising:

outputting measurement sound from at least one speaker unit of the multiple speaker units; and controlling a gain of the speaker unit on a basis of a reverberation characteristic when the measurement sound is measured by a microphone in a predetermined position, wherein the reverberation characteristic includes an impulse response, and a gain is adjusted according to a distance from a linear sum of impulse response measured by respective measurement sounds from the multiple speaker units.

* * * * *